US006588760B2

(12) United States Patent
Carter, Jr. et al.

(10) Patent No.: US 6,588,760 B2
(45) Date of Patent: Jul. 8, 2003

(54) CYLINDRICAL CRANE GAME

(75) Inventors: Shane P. Carter, Jr., Amherst, NY (US); Edward Dluzen, Clarence, NY (US); Michael Andrews, Alden, NY (US)

(73) Assignee: Innovative Concepts in Entertainment, Inc., Clarence, NY (US)

( * ) Notice: Subject to any disclaimer, the term of this patent is extended or adjusted under 35 U.S.C. 154(b) by 0 days.

(21) Appl. No.: 10/037,324

(22) Filed: Nov. 9, 2001

(65) Prior Publication Data

US 2003/0090065 A1 May 15, 2003

(51) Int. Cl.[7] ..... A63F 7/36; A63F 9/00
(52) U.S. Cl. ..... 273/448
(58) Field of Search ..... 279/447, 448

(56) References Cited

U.S. PATENT DOCUMENTS

| | | | | | |
|---|---|---|---|---|---|
| 1,128,039 | A | | 2/1915 | Piercy | |
| 4,181,231 | A | | 1/1980 | Morrissey, Jr. et al. | |
| 4,272,075 | A | * | 6/1981 | Rogers, Jr. | 273/140 |
| 4,718,667 | A | | 1/1988 | Shoemaker, Jr. | |
| 5,271,628 | A | * | 12/1993 | Okada | 221/210 |
| 5,415,417 | A | * | 5/1995 | Reis, Jr. | 273/447 |
| 5,527,044 | A | * | 6/1996 | Lee et al. | 273/448 |
| 5,678,823 | A | * | 10/1997 | Chaffee et al. | 273/351 |
| 5,855,374 | A | * | 1/1999 | Shoemaker, Jr. | 273/447 |
| 5,967,892 | A | | 10/1999 | Shoemaker, Jr. | |
| 6,139,429 | A | * | 10/2000 | Shoemaker, Jr. | 273/448 |
| 6,234,487 | B1 | * | 5/2001 | Shoemaker, Jr. | 273/447 |
| 6,283,475 | B1 | * | 9/2001 | Stubben | 273/447 |
| 6,428,008 | B1 | * | 8/2002 | Singer | 273/447 |

FOREIGN PATENT DOCUMENTS

| | | | | |
|---|---|---|---|---|
| JP | 2000-126441 | * | 5/2000 | A63F/9/00 |

* cited by examiner

*Primary Examiner*—Raleigh W. Chiu
(74) *Attorney, Agent, or Firm*—Simpson & Simpson, PLLC

(57) ABSTRACT

A crane amusement game, including a cylindrically shaped cabinet enclosing a game prize platform, and an apparatus for grabbing a prize arranged on the platform. In a preferred embodiment of the invention the prize platform includes an actuate perimeter. In another embodiment, the invention includes a crane amusement game, including a cabinet enclosing a game prize platform, and, a gantry operatively arranged for rotational movement, and a claw operatively arranged for translational movement, the claw operatively arranged to grab a prize arranged on the platform. In this embodiment, the cabinet may be in any shape, but the gantry is arranged for rotational movement. The invention also includes a method for controlling an apparatus for grabbing a prize in an amusement game.

32 Claims, 39 Drawing Sheets

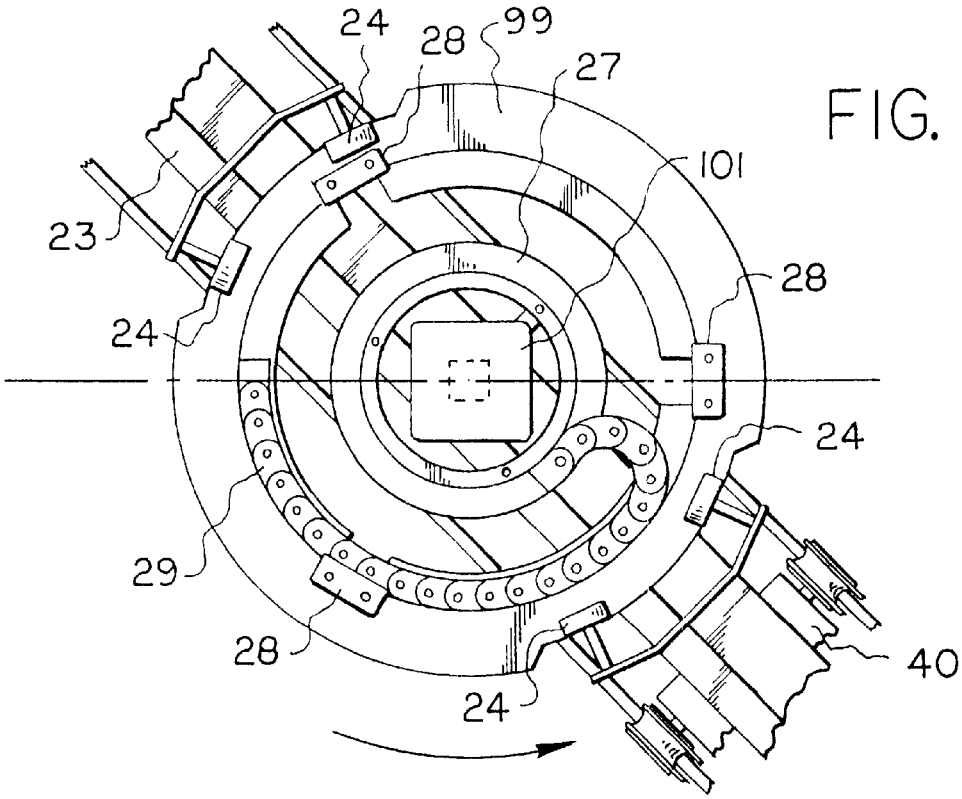
FIG. 3A
FIG. 3B
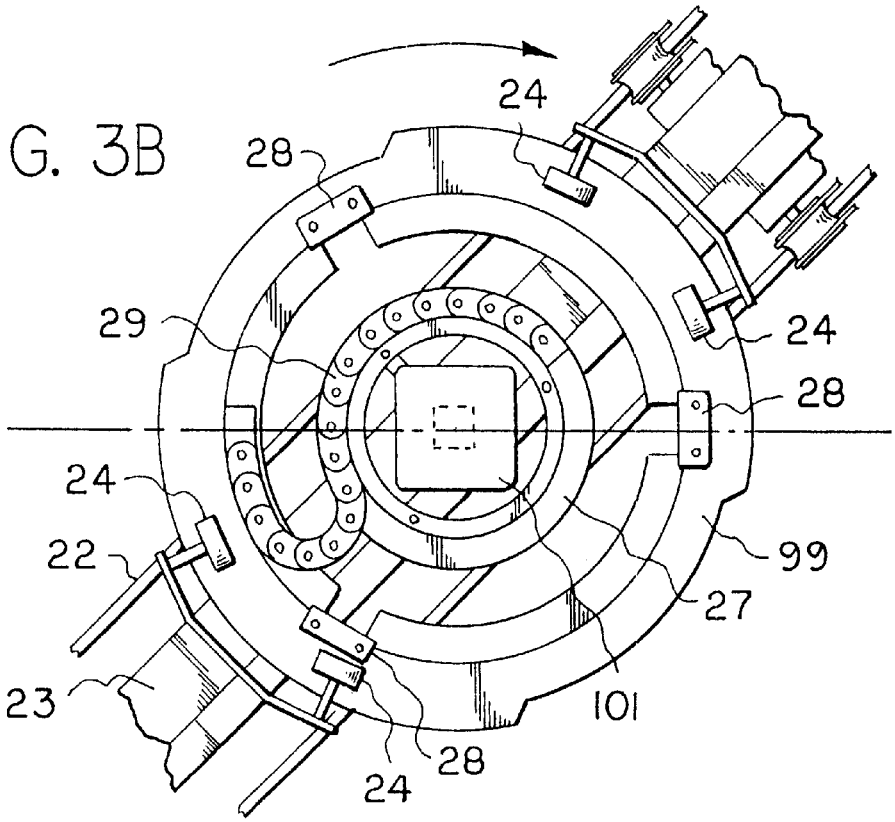

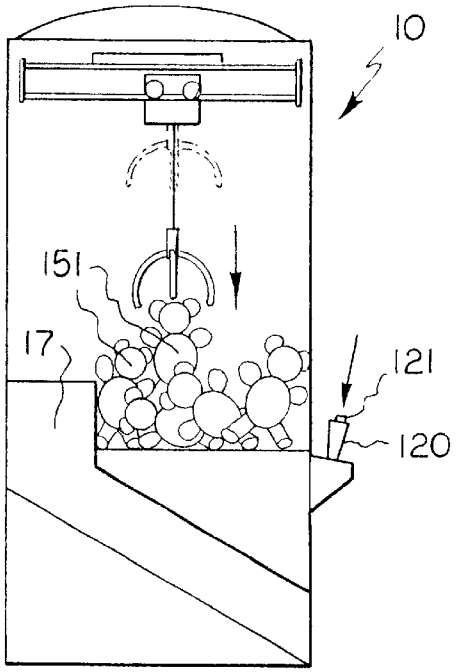
FIG. 13
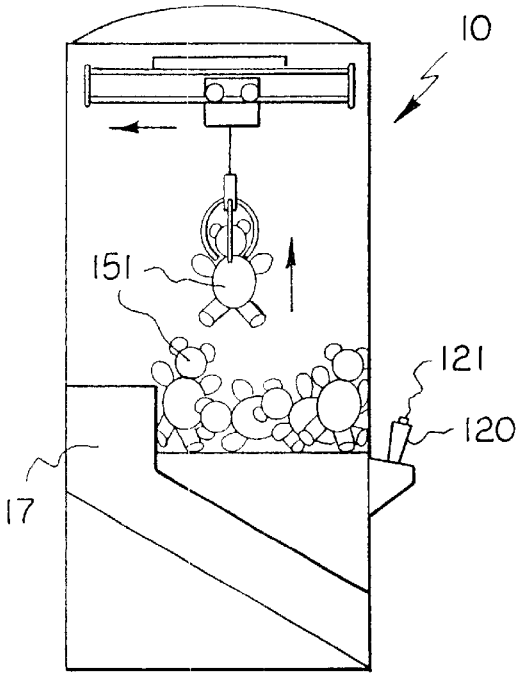
FIG. 14
FIG. 16
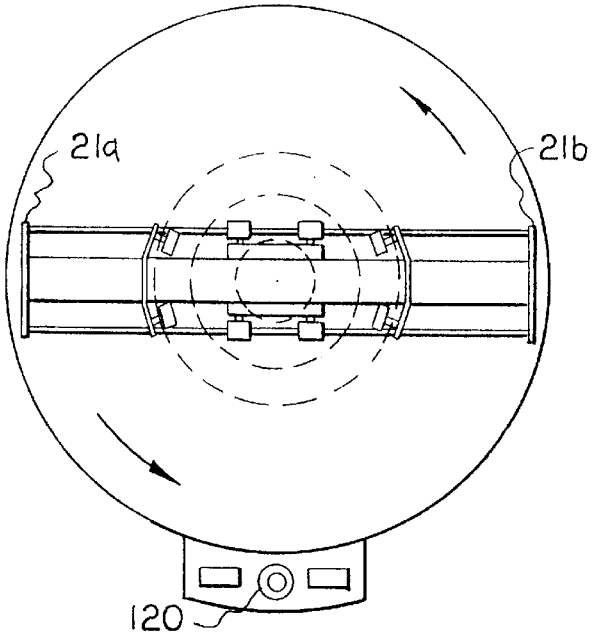
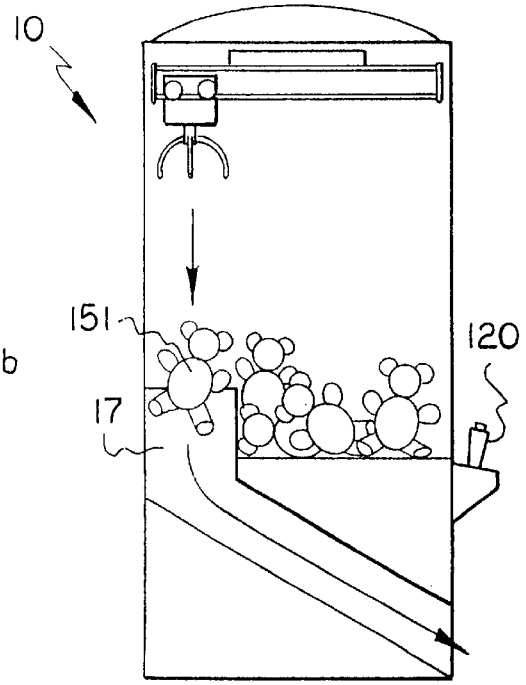
FIG. 15

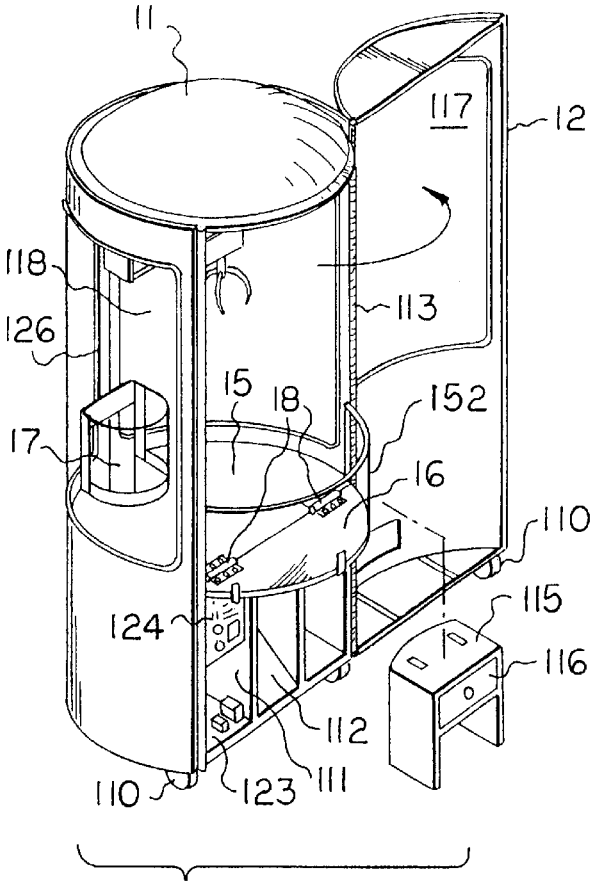
FIG. 17
FIG. 18
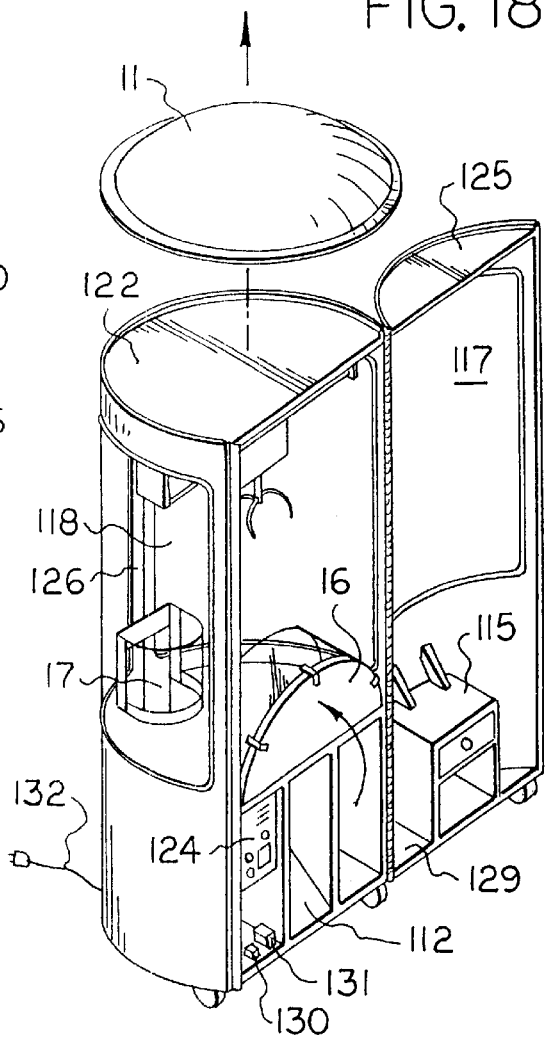
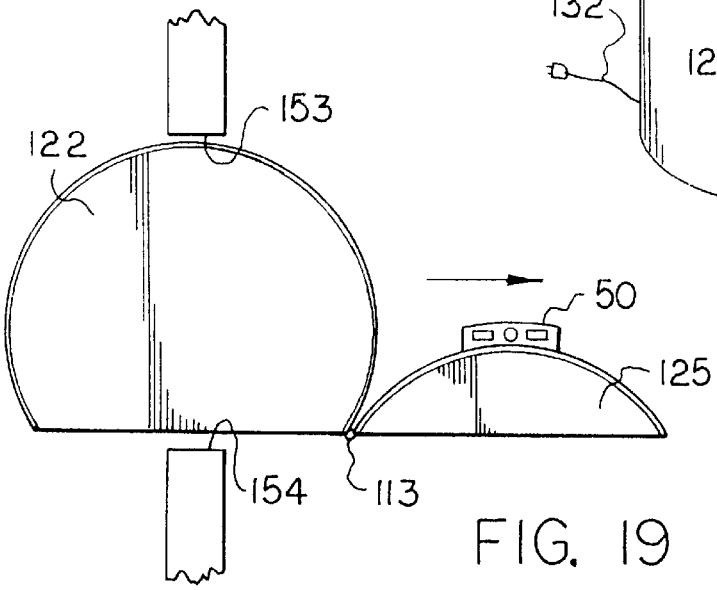
FIG. 19

CYLINDRICAL CRANE GAME

FIELD OF THE INVENTION

The present invention relates generally to amusement games, and, more particularly, to a cylindrical crane amusement game which includes a polar coordinate crane-positioning system.

BACKGROUND OF THE INVENTION

Coin-operated crane type amusement games, in which a player pays money for the opportunity to control a crane (comprising a gantry and claw mechanism) to win toys, novelty items, trinkets, candy and other items are well known. At one time or another most of us have seen, or even played these games at nickelodeons, traveling carnivals, circuses, arcades, amusement parks, restaurants, movie theaters, game rooms, truck stops, bowling alleys, fairs or retail stores. Trying to win prizes from crane games is both fun and challenging. Unlike other redemption games, where one plays for tickets or prizes pre-selected by an arcade or game owner, crane games allow the player to select the prize to be sought. Crane games, then, provide entertainment to men, women and children alike.

A number of crane games are known in the marketplace, including the Plush Bus™, Sports Bus™, London Bus™, Chocolate Factory™ (the world's first crane/pusher candy bar dispensing game), Pinnacle™, Plush Palace™ (a double gantry/crane), Grab 'n Go™, and Carnival™ crane, all of which are manufactured and distributed by the assignee of this patent.

Various improvements have been made in crane games over the years. Cabinets are now made of metal, with epoxy-powder coatings (e.g., Plush Bus™) for protection and longer life. Some games (e.g., Pinnacle™) offer cabinets with beautiful wood finishes. Improvements have been made in the claw structure and operation, and in gantry and claw positioning and control systems. Electronic sensors and switching mechanisms have replaced mechanical sensors. Perhaps the most exciting development in recent years was the combination of a crane and pusher game in the popular Chocolate Factory™ game. In this game, the first of its kind to dispense candy bars as prizes, a player operates a crane to pick up one or more candy bars, and then carefully places the bars on a platform. A "pusher" then pushes the candy bars along the platform, and fall off the end of the platform (hopefully) as prizes.

Despite these advances, all crane games share several structural and functional similarities. First crane game cabinets are generally rectangular in shape. The gantry which moves the crane into position above the target prizes is generally controlled by a joystick, or similar device, in a rectilinear (Cartesian) (XYZ) coordinate system.

One crane game is described by Shoemaker in U.S. Pat. No. 4,718,667. In this patent from 1988, Shoemaker discloses a rectangular, box-like crane amusement game in which a player controls the positioning of a pincer, which can be closed over an object that is to be retrieved. The gantry and claw mechanism of this patented invention operates in the XYZ coordinate system such that the rails on which the gantry moves cross one another with one rail extending above the other. This patented invention also comprises reversible X and Y direction drive motors for moving the gantry back and forth along the perpendicularly aligned rails.

Another box-like crane game utilizing XYZ type movement is described by Shoemaker in U.S. Pat. No. 5,967,892.

In this patent from 1999, which describes a video crane game, Shoemaker again discloses a claw-type game which utilizes an XYZ assembly that allows a player to control the movement of a claw in the XY plane and in a Z direction.

In addition to the relatively few changes in the XYZ movement of gantries in crane games, very little has been done to alter the general rectangular shape of crane amusement games, despite the fact that manufacturers such as Innovative Concepts in Entertainment, Inc., (ICE) have made great improvements in appearance and aesthetic aspects of crane games. For example, ICE currently manufactures customized crane amusement games full of colorful decals and artwork. Some of their games are custom decorated so as to resemble school buses, double-decker buses or 18-wheeled trucks. However, because typical crane games comprise rectangular, box-like structures, dressing up the appearances of the games is limited to imitating real-life items that are box-like themselves (school buses, double-decker buses and 18-wheeled trucks).

While it is desirable to manufacture a non-rectangular crane game (e.g., round, circular, or cylindrical cabinet and prize platform) for advertising, marketing and entertainment purposes, the limitation of an XYZ rectilinear gantry drive and positioning systems has heretofore prevented such a development. Movement of the gantry and claw on perpendicular rails in XYZ planes would be undesirable in a cylindrically shaped cabinet since the retrieving apparatus would not be capable of accessing the outer circumference of the prize platform. Consequently, people would be reluctant to play a game where they were unable to retrieve prizes located along the outer edges of the platform. Thus, developing a gantry and crane system that could access the outer circumference of a round prize platform is prerequisite to creating an entertaining cylindrically shaped crane game.

Heretofore, crane mechanisms arranged for rotational movement have primarily been associated with heavy lifting cranes used in industrial settings. A gantry and crane of this type is disclosed and described in U.S. Pat. No. 4,181,231 (Morrissey, Jr., et al.). In this patent from 1980, a gantry and crane apparatus for lifting heavy nuclear fuel rods is disclosed as comprising a three-point gantry structure (T or Y-shaped) which moves about a circular rail. The three-point structure not only allows the patented gantry and crane to lift heavy fuel rod loads, but also allows the gantry and crane to withstand the stresses of earthquakes.

Another gantry and crane mechanism which operates in a circular plane is disclosed in U.S. Pat. No. 1,128,039 (Piercy). However, this patented invention from 1915 is also structured as a staging or support for lifting heavy objects. The staging and support is designed for performing underwater blasting, mining and other similar submarine operations requiring substantial support means.

However, while gantry and crane assemblies for lifting heavy objects in industrial settings in cylindrical spaces are known, crane assemblies arranged for rotation and movement in a cylindrical coordinate system in games are heretofore unknown. There is a longfelt need, then, for a gantry operatively arranged for rotational and translational movement in a polar coordinate system about a circular prize platform in a crane game.

BRIEF SUMMARY OF THE INVENTION

The present invention broadly comprises a crane amusement game, including a cylindrically shaped cabinet enclosing a game prize platform, and a gantry including a claw, operatively arranged to grab a prize arranged on the platform. In a preferred embodiment of the invention the prize platform includes an actuate perimeter. In another embodiment, the invention includes a crane amusement game, including a cabinet enclosing a game prize platform, and, a gantry including a gantry operatively arranged for rotational movement, and a claw operatively arranged for translational movement, the claw operatively arranged to grab a prize arranged on the platform. In this embodiment, the cabinet may be in any shape, but the gantry is arranged for rotational movement.

A general object of the present invention is to provide a crane amusement game having a cylindrically shaped cabinet enclosing a game prize platform, and a gantry including a claw operatively arranged to grab a prize arranged on the platform.

Another object of the present invention is to provide a crane amusement game having a gantry operatively arranged for rotational movement above a prize platform.

These and other objects, features and advantages of the present invention will become apparent upon reading the following detailed description of the invention in view of the several drawing figures and appended claims.

BRIEF DESCRIPTION OF THE DRAWINGS

The invention will now be described in more detail with reference to the pended drawings in which:

FIG. 3A is a fragmentary top view of the gantry shown in FIG. 3, showing the gantry rotated in a counterclockwise direction with respect to its position in FIG. 3;

FIG. 3B is a fragmentary top view of the gantry shown in FIG. 3, showing the gantry rotated in a clockwise direction with respect to its position in FIG. 3;

FIG. 13 is a side view of the game shown in FIG. 1, taken from the perspective of one viewing the game from the left in FIG. 1, showing the claw of the crane descending toward a desired prize arranged on the prize platform of the game;

FIG. 14 is a view similar to that of FIG. 13, showing the claw of the crane ascending with a prize in its grasp;

FIG. 15 is a view similar to that of FIG. 14, showing the crane positioned over the prize ejection chute, and the claw releasing the prize into the chute;

FIG. 16 is a view similar to that of FIG. 7B, showing how the gantry returns to its "at rest" position after completion of a game;

FIG. 17 is a view similar to that of FIG. 1, but with the front door of the game open to reveal the inner components of the game;

FIG. 18 is a view similar to that of FIG. 17 but with the top dome of the game removed and part of the prize platform folded upwardly to allow the game to pass through a doorway;

FIG. 19 is a top view of the open game shown in FIG. 18, showing how the opened game fits through a doorway;

DETAILED DESCRIPTION OF THE INVENTION

Figure 22:
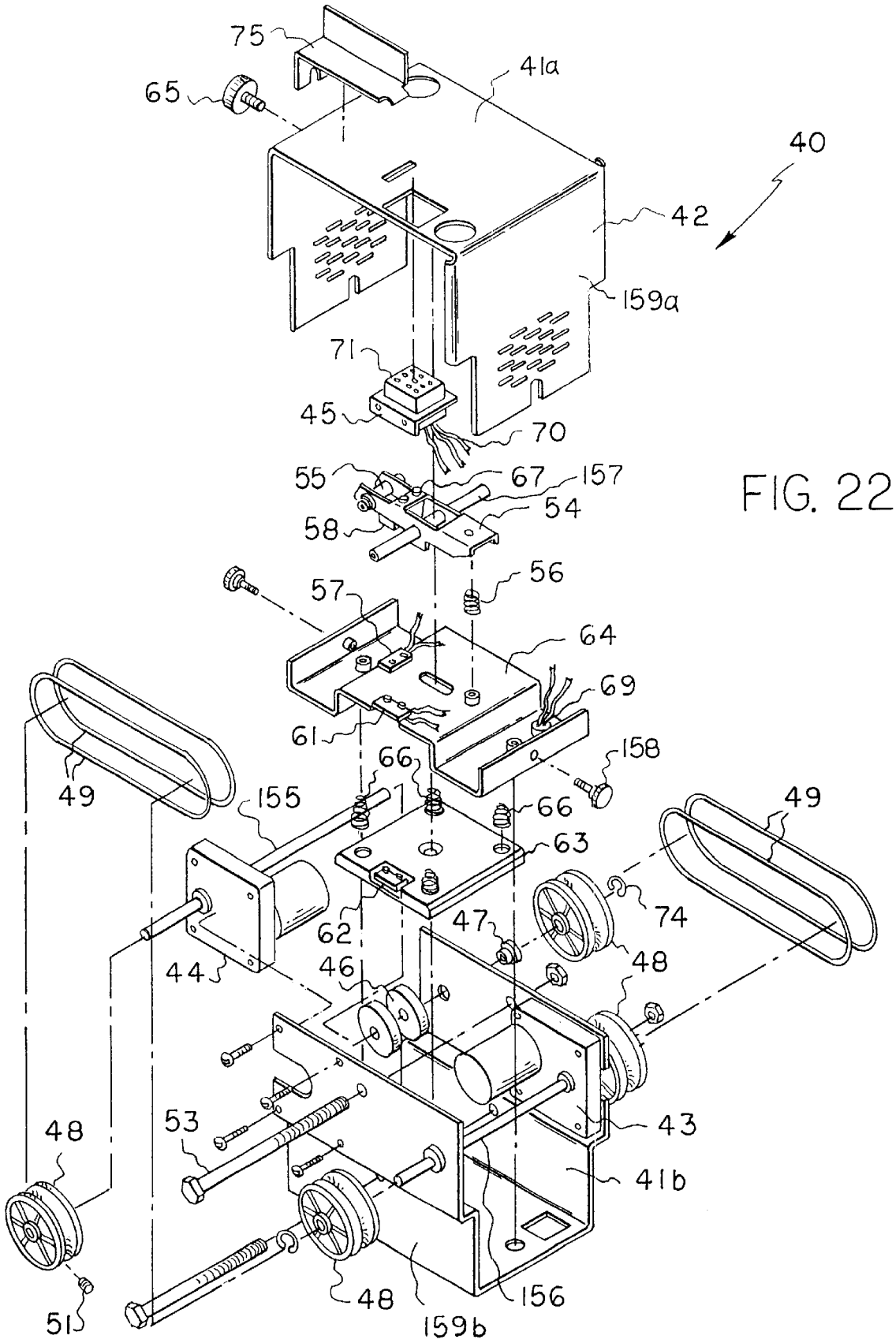
FIG. 22 is an exploded view of the crane assembly showing its internal components.

In the detailed description that follows, identical reference numbers on different drawing views are intended to represent identical structural elements of the invention. In the description that follows, the terms "front" and "back" as they refer to the game refer to the "front" side of the game where player controls are located and the "back" side of the game, which is directly opposite the player controls on the side of the game where the ejection prize chute is located. The terms "front" and "back" when used to describe the gantry are taken from the perspective of the gantry in its initial "coin-up" position prior to play but after insertion of a coin, as shown in FIG. 22. The "rest" position of the gantry refers to the position of the gantry shown in FIG. 7B, prior to insertion of a coin and start of a game. The "coin-up" position of the gantry and the crane assembly refers to the position of the gantry and the crane as shown in FIG. 8, after insertion of a coin. The "home" position refers to the position of the gantry shown in FIG. 15, wherein the claw assembly is positioned for dropping a game prize into the prize ejection chute. The terms "clockwise" and "counter-clockwise" are used from the perspective of one viewing the game from the top of the game cabinet.

General movement of the gantry, crane and claw of the invention are referenced in a modified polar (r-θZ-) coordinate system, as described infra.

The crane game of the present invention generally comprises a cylindrical game cabinet enclosing a gantry, a crane assembly, a claw and game prizes on a prize platform. The primary object of the game is to maneuver the gantry and crane assembly over a desired game prize, lower the claw, and secure the prize. The claw is then automatically raised, positioned above a prize chute and the prize then dropped into the chute for receipt by the player. Maneuvering of the gantry and crane assembly is accomplished by means of a joystick located on the outside of the cylindrical cabinet. The joystick is used to control the rotational and translational movement of the gantry and crane. Once a player has positioned the crane over the desired prize, pressing a drop button on the joystick lowers the claw until it makes substantial contact with the desired prize or other prizes on the prize platform. Once the claw has made substantial contact with the prizes on the prize platform, it is signaled to close in an attempt to secure a prize. Once closed, the claw is then automatically raised and positioned over the prize chute for automatic release of any prizes. Released prizes then fall into the prize chute for receipt by the player.

It should be appreciated by those having skill in the art that although the crane game of the present invention comprises a "claw assembly" as having claw fingers for grasping game prizes, "claw assembly" can include any type of assembly that can be used to grasp game prizes, including but not limited to: hooks, magnetic assemblies, vacuum assemblies, hook and loop fastener assemblies, and other types of gripping, grabbing, or adhesive mechanisms. It should also be appreciated by those having skill in the art that although the crane game of the present invention comprises a crane assembly having wheels operatively arranged for translational movement upon parallel rails, other means for translationally moving the crane assembly are contemplated, which means include but are not limited to: monorail means, belt means, chain means or magnetic means.

STRUCTURE OF APPARATUS OF THE INVENTION

The general structural elements of the present invention, which enable one having ordinary skill in the art to make the invention, will now be described in more detail by general reference to FIGS. 1–6B, 13, and 17–25.

General

Figure 1:
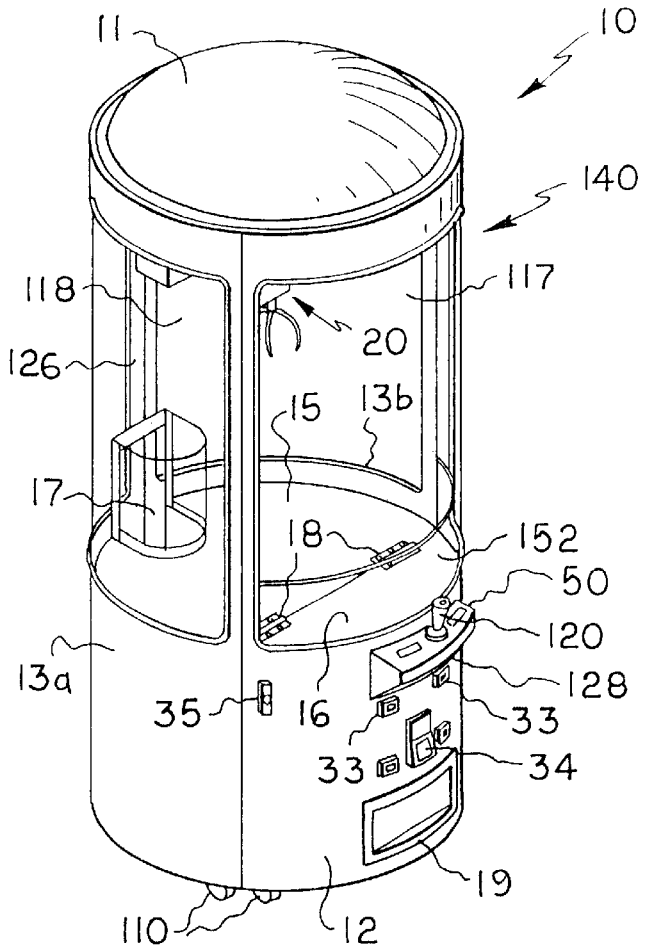
FIG. 1 is a perspective view of the cylindrical crane game of the invention.

General exterior and interior structures are best viewed by referring to FIGS. 1, 17 and 18 which are perspective views of the general structures of crane game 10 of the present invention. Adverting now to FIG. 1, crane game 10 generally comprises cylindrical cabinet 140. Cylindrical cabinet 140 comprises dome 11, front door 12, and right and left side panels 13*a* and 13*b*, respectively. Front door 12 includes control panel 50, which comprises joystick 120 (commercially available from Industrias Lorenzo S.A. of Barcelona, Spain), displays 119 (shown in FIG. 7B), and drop button 121 (shown in FIG. 7B). Also located in front door 12 is coin mechanism holder 33 (commercially available from Entropy International Co., Ltd. of Elk Grove Village, Ill.) operatively arranged to receive coins for playing the game, dollar bill validator 34 (commercially available from Mars Electronics International of West Chester, Pa.) operatively arranged to receive paper money to play the game, T-lock handle 35 for locking front door 12, and prize door frame 19, for retrieving game prizes dropped into prize ejection chute 17. Front and rear prize platforms 16 and 15, respectively, are located within cabinet 140 and form a generally round prize platform. The two platforms are hingedly secured to one another by means of hinges 18. It should be appreciated by those having skill in the art that although the preferred embodiment comprises a circular prize platform, the present invention may include other polygonally or actuate shaped prize platforms.

FIGS. 17 and 18 show perspective views of crane game 10 with front door 12 open. Crane game 10 further comprises front door window 117 and window retainer 126 for securing side windows 118. Window retainer 126 additionally passes power and electronic communications cables (not shown) to motor 101 (shown in FIG. 2) and gantry 20 (shown in FIG. 2), which are operatively arranged to rotate crane assembly 40 above the prize platform. As shown in FIGS. 17 and 18, front door 12 is hingedly secured to cylindrical cabinet 140 by means of door hinge 113 Front door 12 additionally comprises front door window 117, door top 125 and door bottom 129, to which casters 110 attach for moving crane game 10. Cash box enclosure 114 is secured inside of front door 12. Cash box 116 slides into cash box enclosure 114, which is locked with cashbox lock 127. Crane game 10 also comprises main electronics board 124 and prize deflector 112, which transports prizes 151 (shown in FIG. 13) from prize ejection chute 17 to prize door 19. Crane game 10 further comprises cabinet bottom 123 which secures a plurality of casters 110 for moving crane game 10. As seen in FIG. 18, power cable 132, power inlet 131 and power transformer 130 are included for providing power to crane game 10.

As generally shown in FIGS. 18 and 19, crane game 10 of the present invention is structured so as to be easily moved and capable of fitting through conventional doorways. As shown in FIG. 18, passing crane game 10 through a doorway (defined by walls 152 and 153) is easily accomplished by removing dome 11, swinging door 12 open, and raising front platform 16. This is an obvious advantage of the cylindrically shaped crane game of the present invention over conventional rectangular shaped games. When configured in this manner, prizes 151 remain within the playing surface by means of plexi-glass prize fence 152 attachably secured to front prize platform 16.

The Gantry

Gantry 20 and crane assembly 40 are operatively arranged to provide rotational and translational positioning of claw assembly 79 for securing game prizes on the prize platform. The gantry rotates about cylindrical cabinet 140 and supports the crane assembly, which is arranged for translational movement on rails 22. A detailed view of the gantry, the crane and the claw assembly is best viewed in FIG. 4, which shows a side view of the gantry, the crane assembly and the claw assembly generally taken along line 4—14 of FIG. 3. As shown in FIG. 4, the claw assembly is secured to the crane assembly, which is operatively arranged for translational movement upon the gantry.

Figure 2:
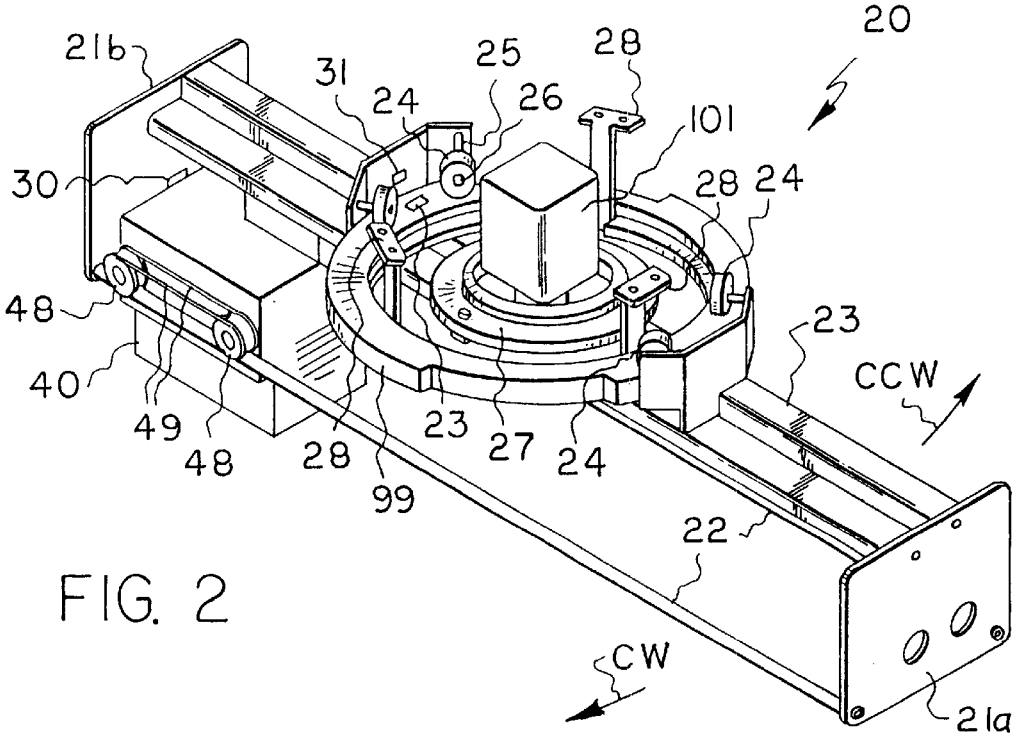
FIG. 2 is a perspective view of the gantry of the present invention.
Figure 3:
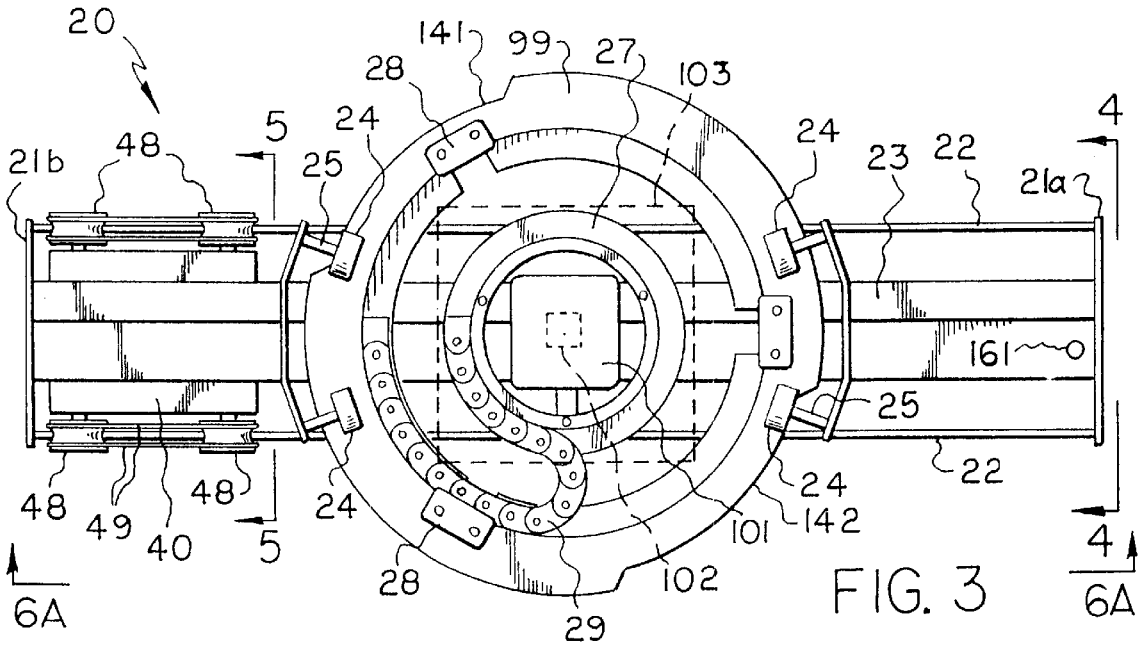
FIG. 3 is a top view of the gantry shown in FIG. 2.
Figure 4:
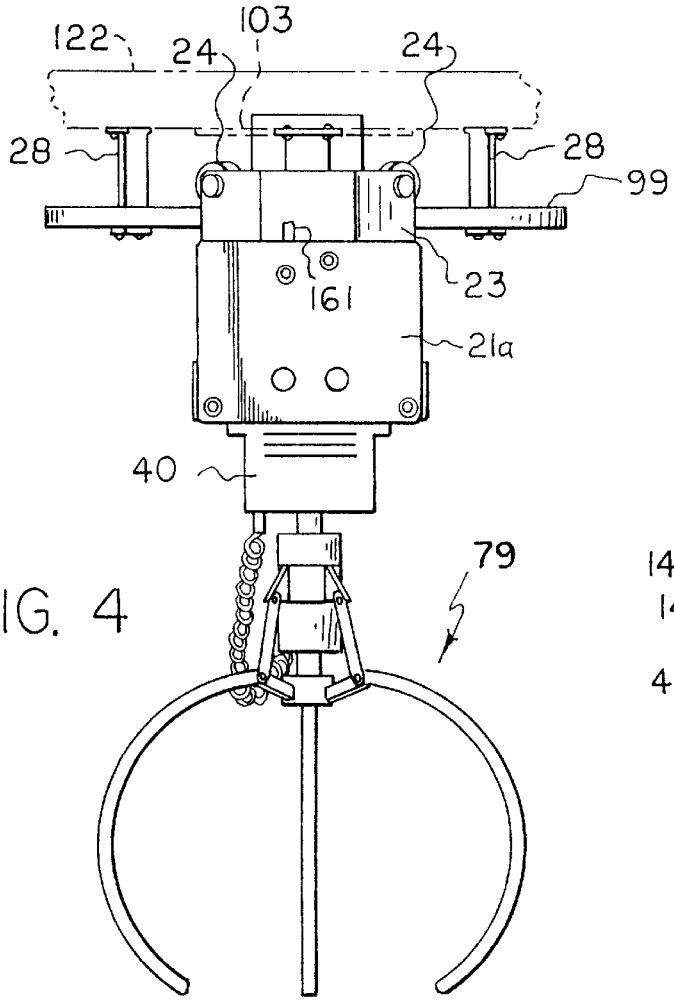
FIG. 4 is a front view of the gantry and claw assembly of the crane game of the invention, taken generally along line 4—4 in FIG. 3.
Figure 5:
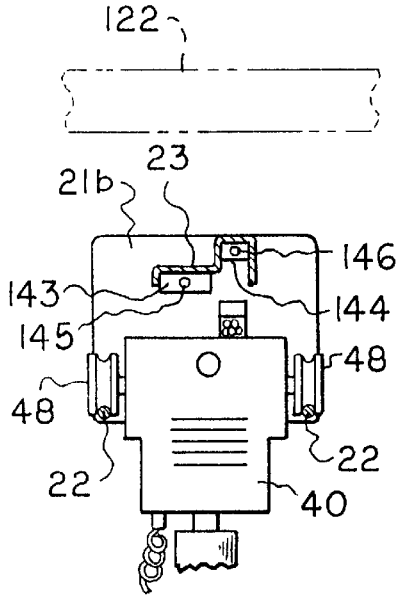
FIG. 5 is a view of the crane of the crane game of the invention, taken generally along line 5—5 in FIG. 3.

Adverting now to FIGS. 2, 3 and 5. FIG. 2 is a perspective view of gantry 20 and crane assembly 40, which translationally moves along rails 22 of gantry 20. It should be appreciated that, in a preferred embodiment, we describe movement of the gantry and crane assembly 40 in a "modified" polar coordinate system. Rotational movement in the modified coordinate system occurs in clockwise (CW) and counterclockwise (CCW) directions as viewed from the top of the game as shown in FIGS. 7–12 and 16. Translational movement in the modified polar coordinate system is defined in positive r+ and r− directions wherein radial movement in the r+ direction refers to crane assembly movement directed toward endplate 21*b* of the gantry and radial movement in the r+ direction refers to crane assembly movement toward endplate 21*a* of the gantry.

As seen in FIG. 2, gantry 20 of the present invention generally comprises parallel rails 22, separator 23 and endplates 21*a* and 21*b*. Parallel rails 22 of gantry 20 are fixedly secured to endplates 21*a* and 21*b* to form a track for supporting and providing translational movement to crane assembly 40. Gantry 20 also comprises separator 23, which is fixedly secured to endplates 21*a* and 21*b*. As seen in FIG. 5, which is a side view of gantry 20 taken generally along line 5—5 of FIG. 3, separator 23 has a "bent" configuration and comprises flap mounts 143 and 144 which attach separator 23 to endplates 21*a* and 21*b* by means of bolts 145 and 146, respectively. The "bent" configuration of separator 23 forms a channel in which translational micro-track 32 (shown in FIGS. 3*a* and 2*b*) (commercially available from IGUS, Inc. of East Providence, R.I.) moves in coordination with the translational movement of crane assembly 40, as described infra. Also secured to separator 23 are rotator wheels 24 secured by wheel spacers 25 and wheel caps 26. Rotator wheels 24 provide rotational movement by allowing gantry 20 to roll upon outer hoop 99.

Inner hoop 27 is secured to separator 23 and is operatively arranged to engage motor coupler 102 (shown in FIGS. 3 and 6*a*), which is operatively arranged for "floatable" engagement with motor 101, a brushless 24 v DC motor (commercially available from Oriental Motor USA Corp. of Torrence Calif.). The "floatable" engagement of the motor coupler and motor 101 allows the motor coupler to move with respect to the motor shaft to prevent jamming of the gantry. As shown in phantom in FIG. 3, motor 101 is secured to cabinet top 122 by means of motor bracket 103 in accordance with the manufacturer's instructions found in the owner's manual, which is incorporated herein by reference. Thus, motor 101 is operatively arranged for rotating the gantry upon outer hoop 99.

Outer hoop 99 comprises the surface upon which rotator wheels 24 roll for providing rotational movement to the gantry. As shown in FIG. 4, the outer hoop is fixedly secured to cabinet top 122 by means of outer hoop supports 28 (shown in FIG. 2). Thus, outer hoop 99 is operatively arranged to remain stationary. Secured to outer hoop 99 is clockwise/counterclockwise actuator 73 (commercially available from Hamlin of Lake Mills, Wis.), which acts upon rotational "home" position sensor 31 (commercially available from Hamlin of Lake Mills, Wis.) of gantry 20 for determining rotational "home" position.

Referring now to FIG. 3, which shows a top view of gantry 20 and outer hoop 99. As can be seen by FIG. 3, outer hoop 99 further comprises notches 141 and 142, which provide a means for removing the gantry from the outer hoop. To remove the gantry from the outer hoop, motor coupler 102 (shown in FIGS. 3 and 6*a*) is uncoupled from the gantry at separator 23. The gantry is then rotated such that rotator wheels 24 align with notches 141 and 142, respectively. Sliding gantry 20 toward either notch 141 or 142 allows one pair of rotator wheels 24 to be lowered from the outer hoop. Likewise, sliding the gantry in the opposite direction then allows the remaining pair of rotator wheels, and ultimately the gantry, to be removed from the outer hoop. FIG. 3 also shows rotational microtrack 29, which extends from the outer hoop to inner hoop 27.

Rotational microtrack 29 (commercially available from IGUS, Inc. of East Providence, R.I.) is a cable carrying system that passes power and communications cables to the crane assembly and the claw assembly and allows the gantry to rotate in clockwise and counterclockwise directions without causing cable entanglement. The movement of rotational microtrack 29 is best shown in FIGS. 3, 3*a* and 3*b*. FIG. 3 shows the position of rotational microtrack 32 when gantry 20 is in the "rest" position. As shown in FIG. 3*a*, counterclockwise rotation of the gantry from the "rest" position causes the rotational microtrack to move along the inner surface of outer hoop 99. By contrast, clockwise movement of the gantry from the "rest" position causes the rotational microtrack to move along the inner hoop as shown in FIG. 3*b*. Rotational stop stud 161 is secured to separator 23 for engagement with window retainer 126 to prevent 360° rotation of the gantry.

Figure 6A:
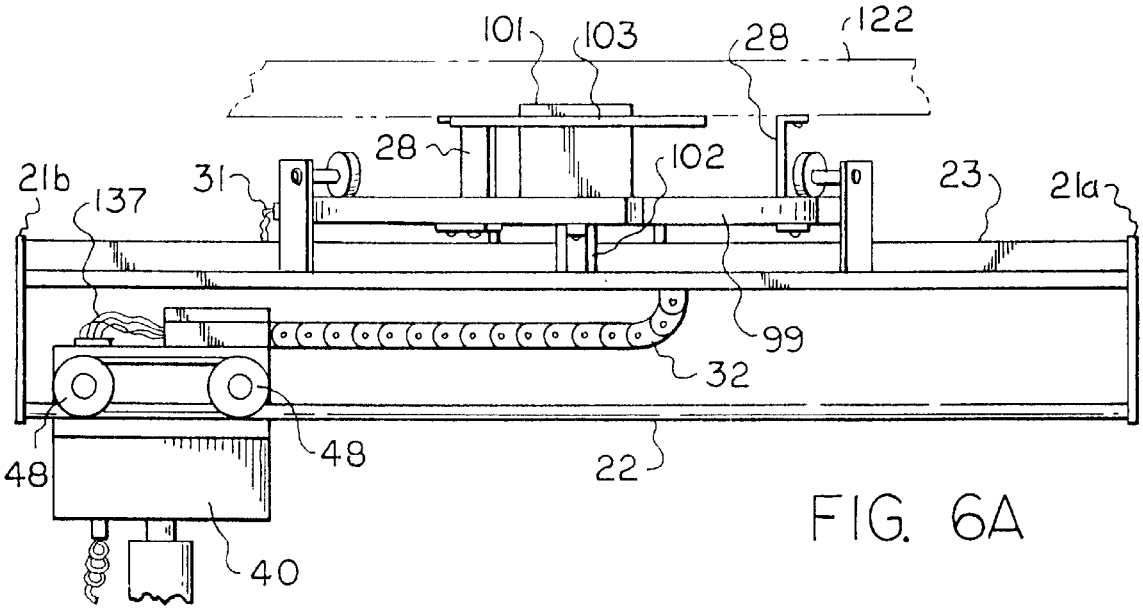
FIG. 6A is a side view of the gantry shown in FIG. 3, illustrating structure of the "front-back" micro-track of the gantry, which view is taken generally along line 6A—6A in FIG. 3.
Figure 6B:
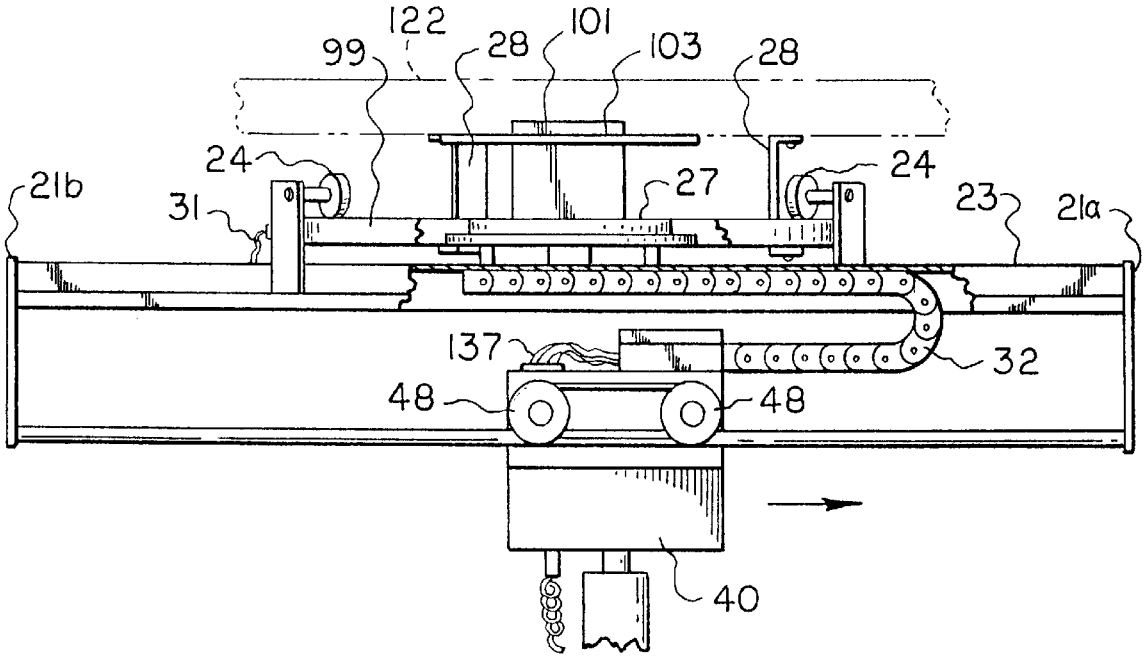
FIG. 6B is a view similar to that of FIG. 6A, but with the crane shown moving toward the front of the gantry.

Adverting now to FIGS. 6*a* and 6*b*, which shows translational movement of the crane assembly along gantry rails 22. As shown in FIGS. 6*a* and 6*b*, arranged between separator 23 and crane assembly 40 is translational microtrack 32. Translational microtrack 32 (commercially available from IGUS, Inc. of East Providence, R.I.) passes cables 137 to crane assembly 40 and provides power and electronic communications to the crane assembly and to the claw assembly. As shown in cut out view in FIG. 6*b*, translational microtrack 32 moves through the channel formed in the "bent" portion of separator 23 in coordination with the translational movement of the crane assembly.

The Crane

Figure 20:
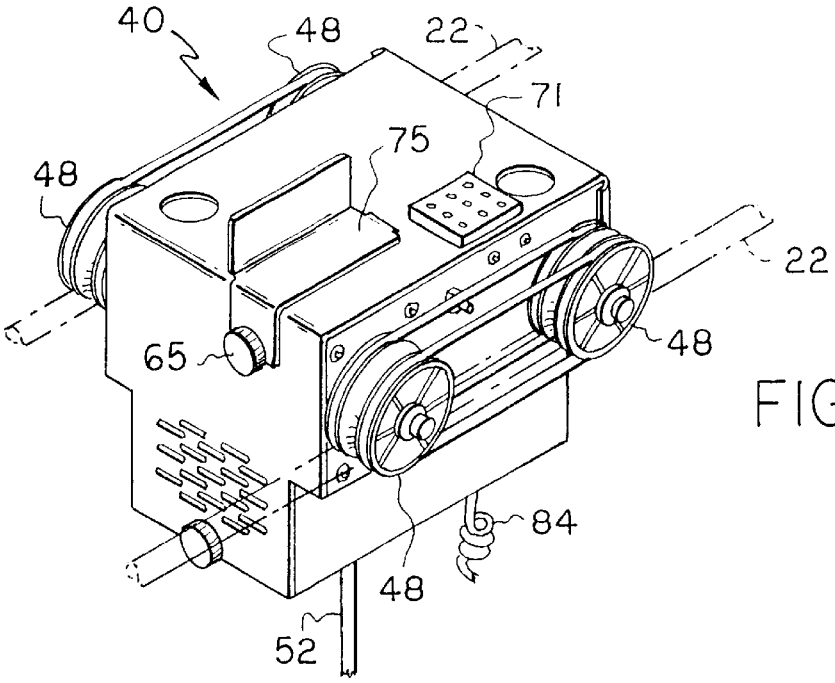
FIG. 20 is a perspective view of the "front" of the crane assembly of the gantry.
Figure 21:
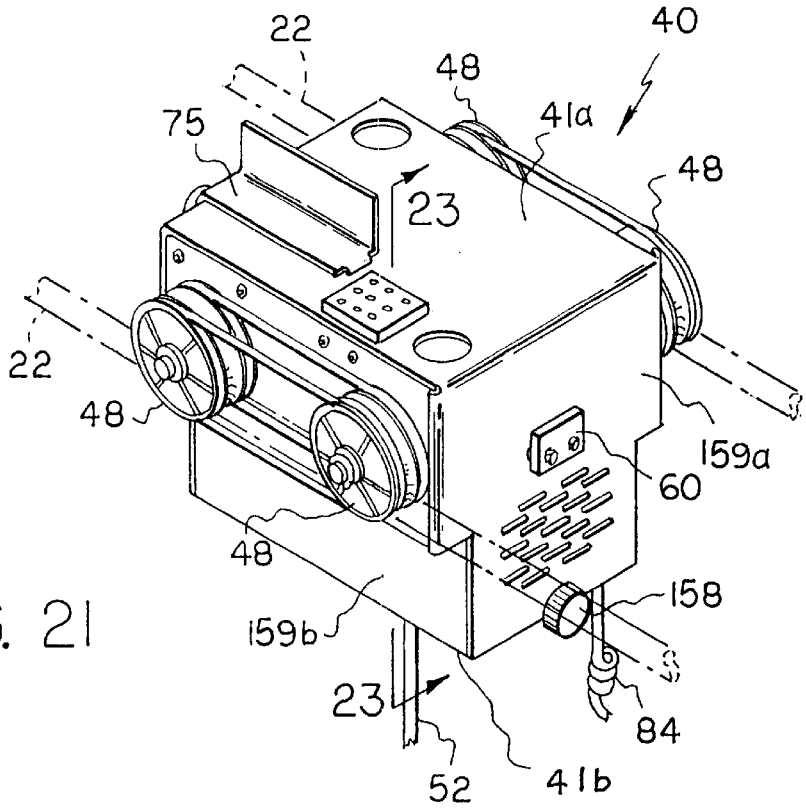
FIG. 21 is a perspective view of the "back" of the crane assembly of the gantry.

Vertical and translational movement of the claw assembly are generally provided by means of the crane assembly. Adverting now to FIGS. 20 and 21, which generally show perspective views of the crane assembly. As shown in FIGS. 20 and 21, crane assembly 40 generally comprises housing top 41*a* and housing bottom 41*b*, which are secured to each other by means of thumbscrews 158. Both housing top 41*a* and housing bottom 41*b* are U-Shaped such that they comprise sides 159*a* and 159*b*, respectively. Track mount 75 attaches to the housing top and secures translational microtrack 32 to the crane assembly. Communications bus 71 (commercially available from Tyco Electronics of Harrisburg, Pa.) is provided for passing power and electronic signals from main electronics board 124 to the crane assembly and the claw assembly of the crane game. Crane wheels 48 provide movement of the crane assembly along parallel rails 22 of gantry 20. Front/back axle 156 attach to the crane wheels and engage front/back motor 43 (shown in FIG. 22). Operatively arranged about crane wheels 48 are O-ring belts 49, which coordinate rotational movement of the crane wheels such that the crane wheels rotate in unison. It should be appreciated that the crane wheels secured to up/down axle 155 (shown in FIG. 22) are not engaged by up/down axle 155.

An exploded view of the crane assembly is shown in FIG. 22. As shown in FIG. 22, the internal components of the crane assembly generally include: crane cable lever 54, coil stop block cover 64, coil stop block 63, up/down motor 44 (commercially available from Merkle-Korff of Chicago, Ill.), front/back motor 43 (commercially available from Merkle-Korff of Chicago, Ill.), up down axle 155, front/back axle 156, and spool sides 46.

Figure 23:
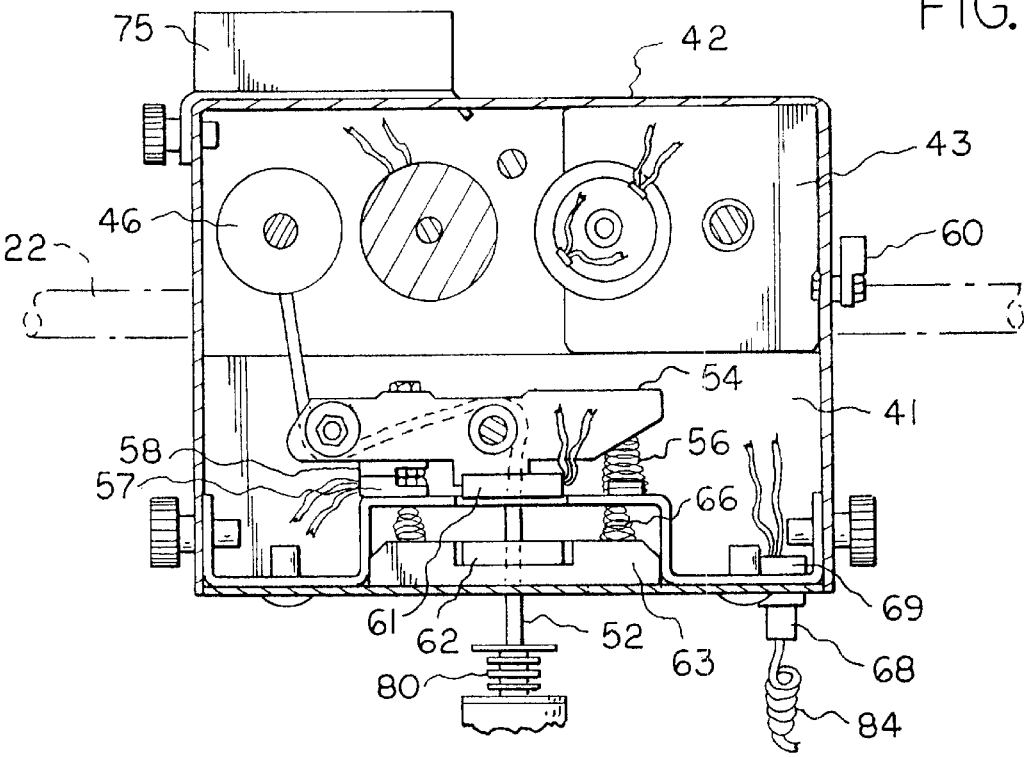
FIG. 23 is a side view of the crane assembly showing the crane cable lever in the lowered position and the coil stop block in a lowered position, which view is taken generally along line 23—23 of FIG. 21.
Figure 24:
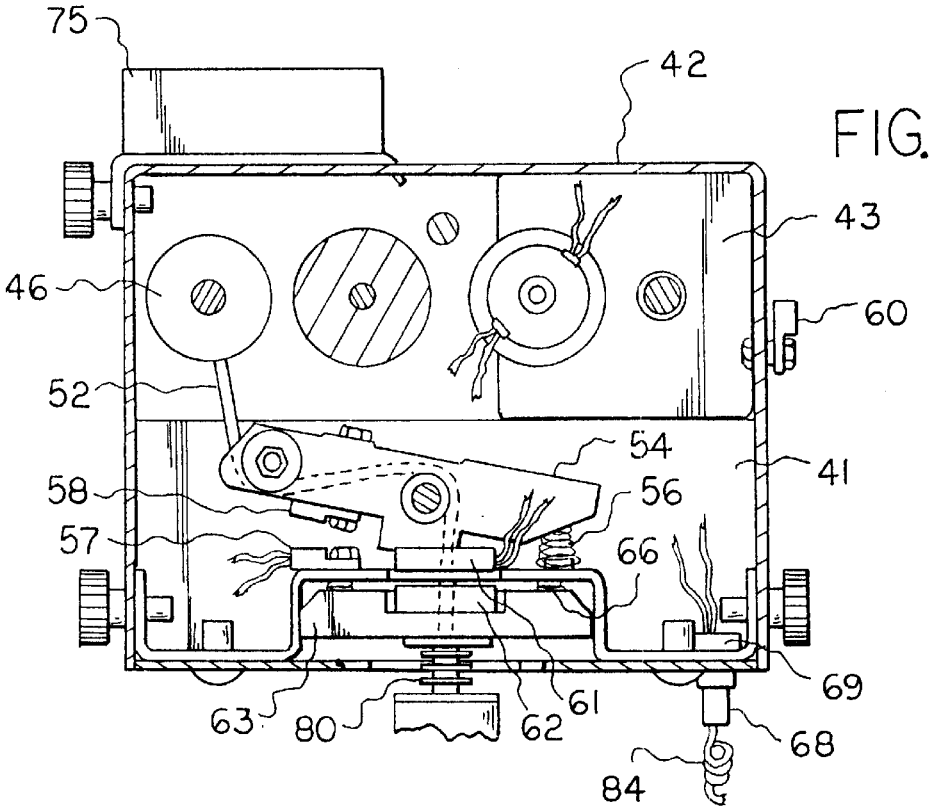
FIG. 24 is a side view of the crane showing the crane cable lever in the raised position and the coil stop block in a raised position, which view is taken generally along line 23—23 of FIG. 21.

As shown in FIG. 22, crane cable lever 54 comprises tubular sheath 157, which is operatively arranged for loose fit about housing separator 53. Crane cable lever 54 also comprises roller shaft 55, cable guide 67, and down actuator 58 (commercially available from Hamlin of Lake Mills, Wis.). As shown in FIGS. 23 and 24, nylon cable 52 (See FIG. 25) passes over tubular sheath 157, under roller shaft 55 and is secured to up/down axle 155. Spool sides 46 are provided on up/down axle 155 for spooling nylon cable 52. Crane cable lever 54 is secured in place by means of housing separator 53, which passes through tubular sheath 157 and is secured at sides 159*b*. Since the tubular sheath loosely fits about housing separator 53, the crane cable lever is capable of pivoting up and down and actuated by nylon cable 52 and spring 56.

Coil stop block cover 64 is positioned below the crane cable lever and is ecured to housing bottom 41*b*. The coil stop block cover comprises down sensor 57 commercially available from Hamlin of Lake Mills, Wis.) operatively arranged for ontacting the down actuator of the crane cable lever. The coil stop block cover also comprises up sensor 61 (commercially available from Hamlin of Lake Mills, Wis.), which is operatively arranged to contact up actuator 62 (commercially available from Hamlin of Lake Mills, Wis.) of coil stop block 63. Spring 56 is operatively arranged between coil stop block cover 64 and crane cable lever 54. FIG. 22 also shows coil stop block 63 positioned below coil stop block cover 64. Coil stop block 63 comprises "up" actuator 62, which is operatively arranged for contacting "up" sensor 61 of coil stop block cover 64. Springs 66 are operatively arranged between the coil stop block and the coil stop block cover which prevent non-actuated contact between up sensor 61 and actuator 62. Crane 40 also secures claw cord 84 (commercially available from Autac, Inc of North Branford, Conn.) for passing power and electronic communications cables to claw assembly 79.

The Claw

Figure 25:
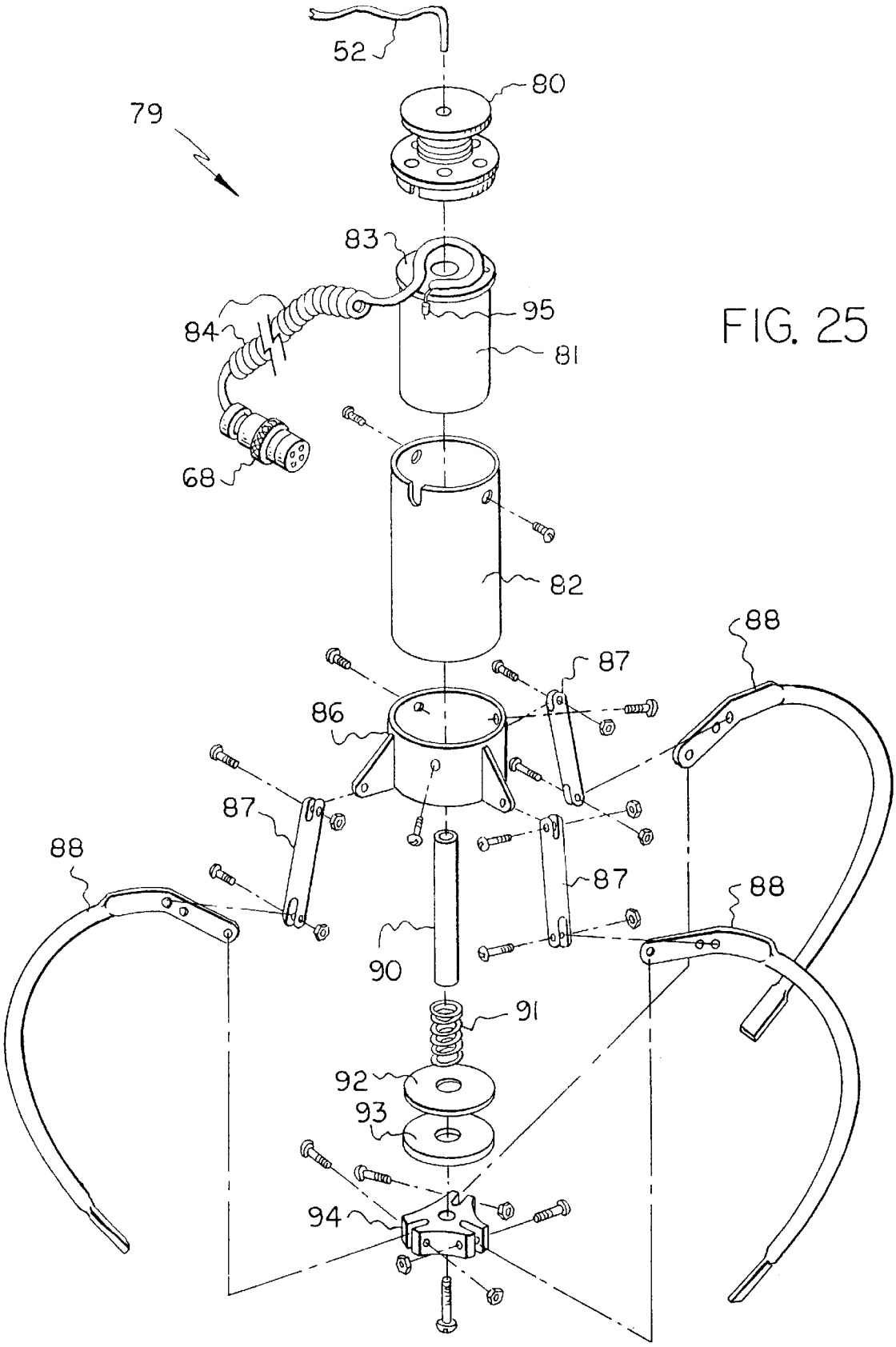
FIG. 25 is an exploded view of the preferred embodiment of the claw assembly of the present invention.

Adverting now to FIGS. 25–27, in which FIG. 25 shows an exploded view of claw assembly 79 of the preferred embodiment. As shown in FIG. 25, the claw assembly of the present invention generally comprises claw cord 84, coil cap 80, coil housing 82, claw interconnect holder 86, a plurality of claw interconnects 87, plunger 90, spring 91, claw fingers 88, washers 92 and 93, respectively, and claw spider 94.

Figure 35:
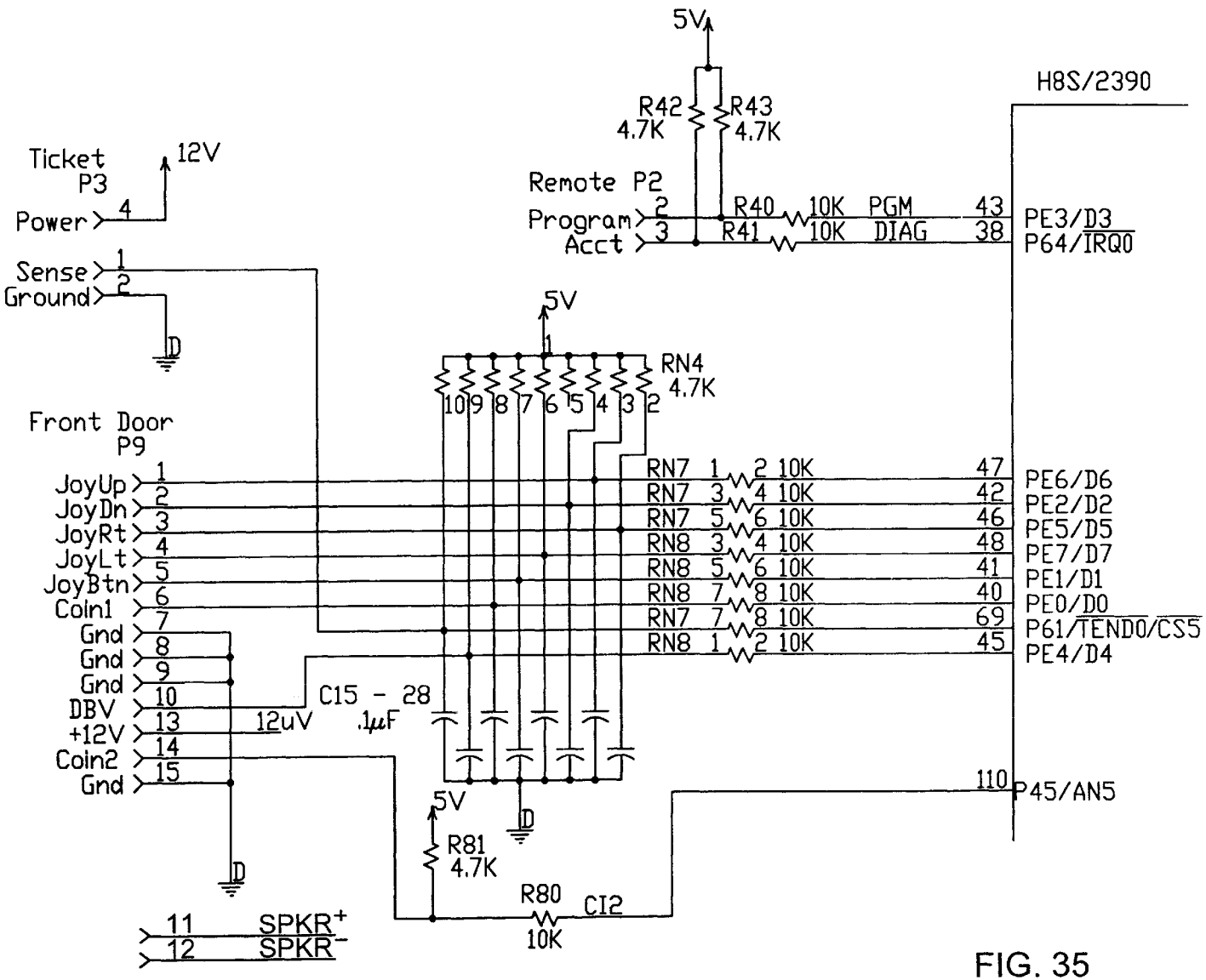
Figure 36:
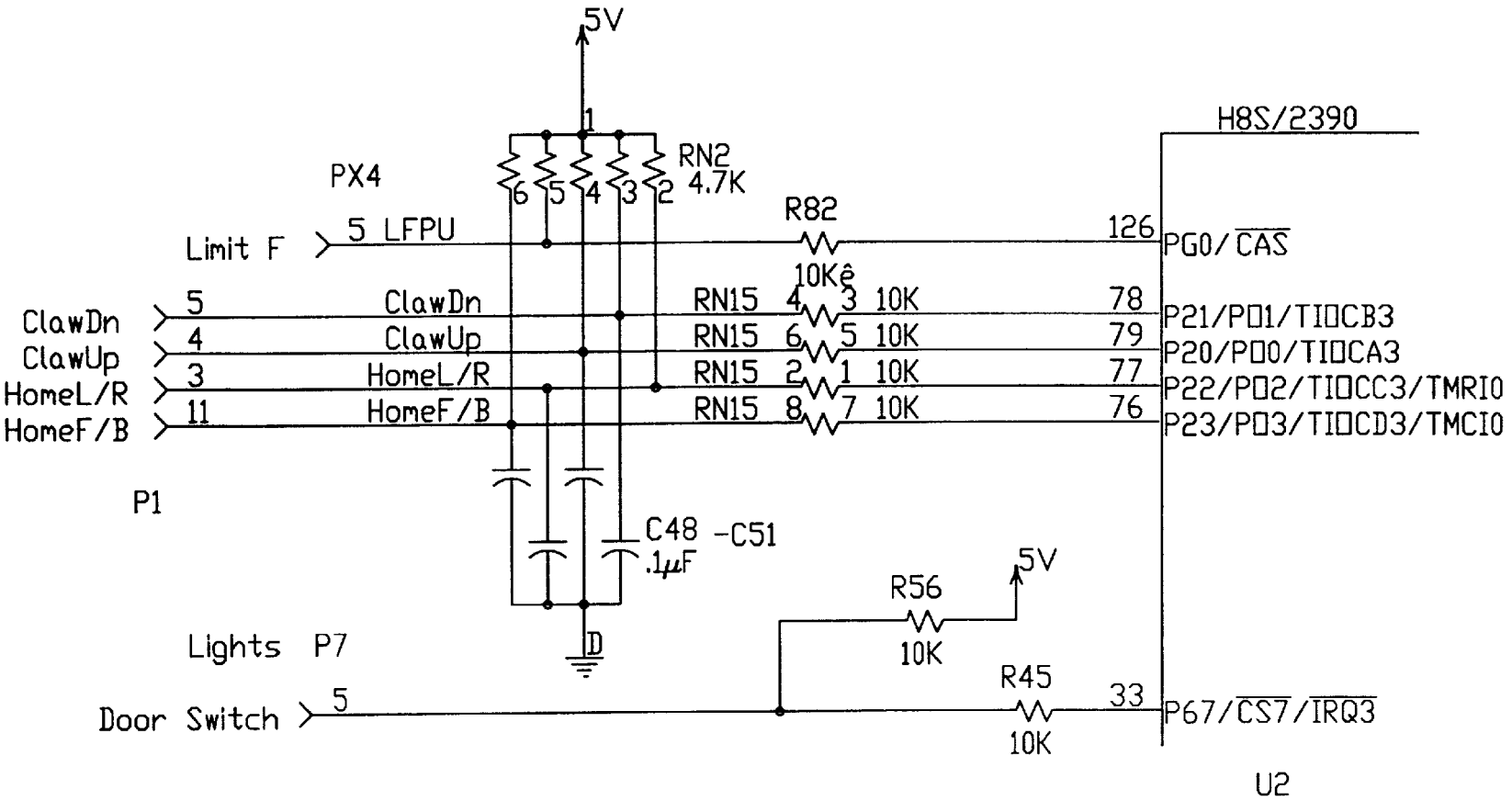
Figure 37:
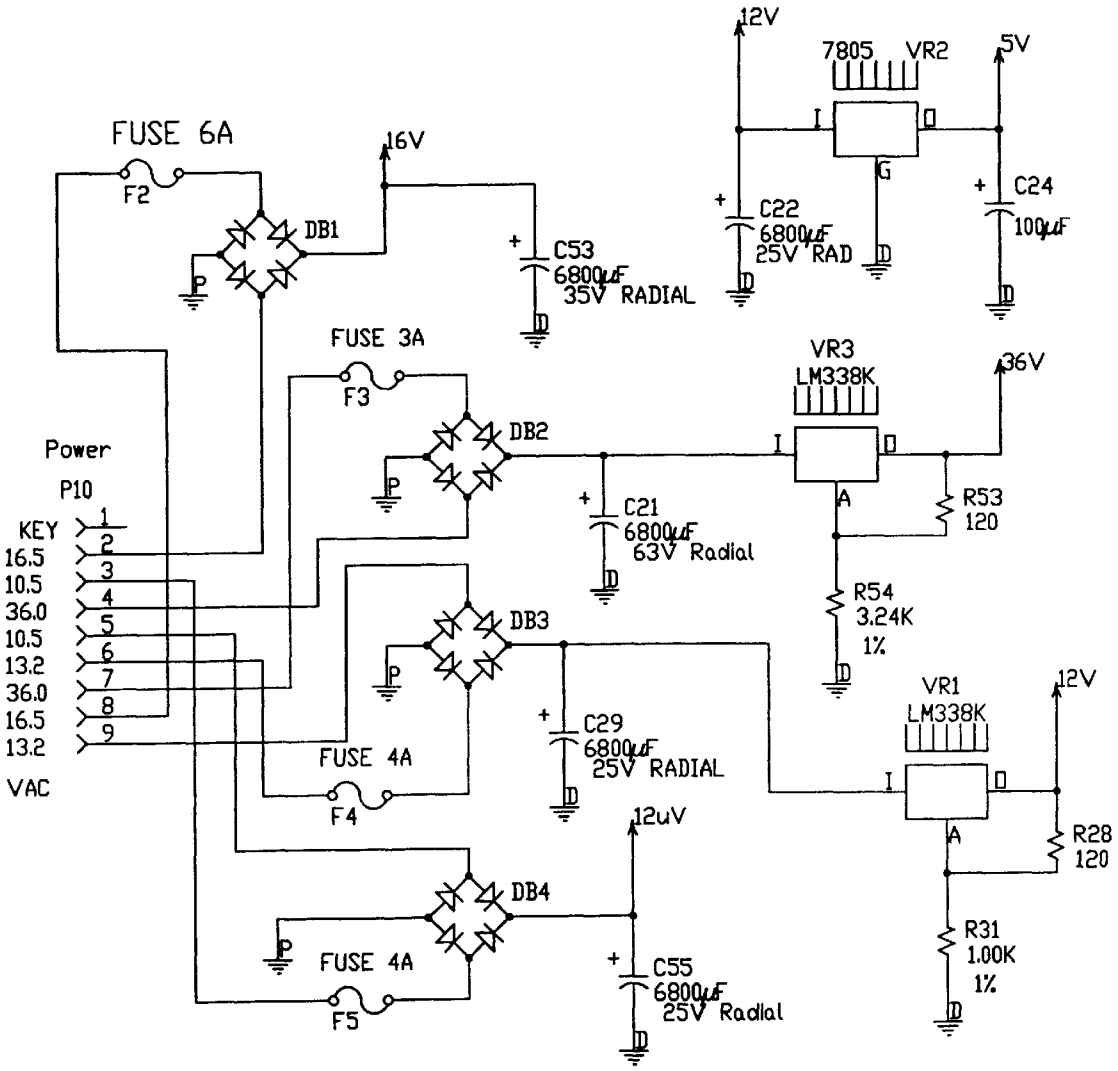
Figure 38:
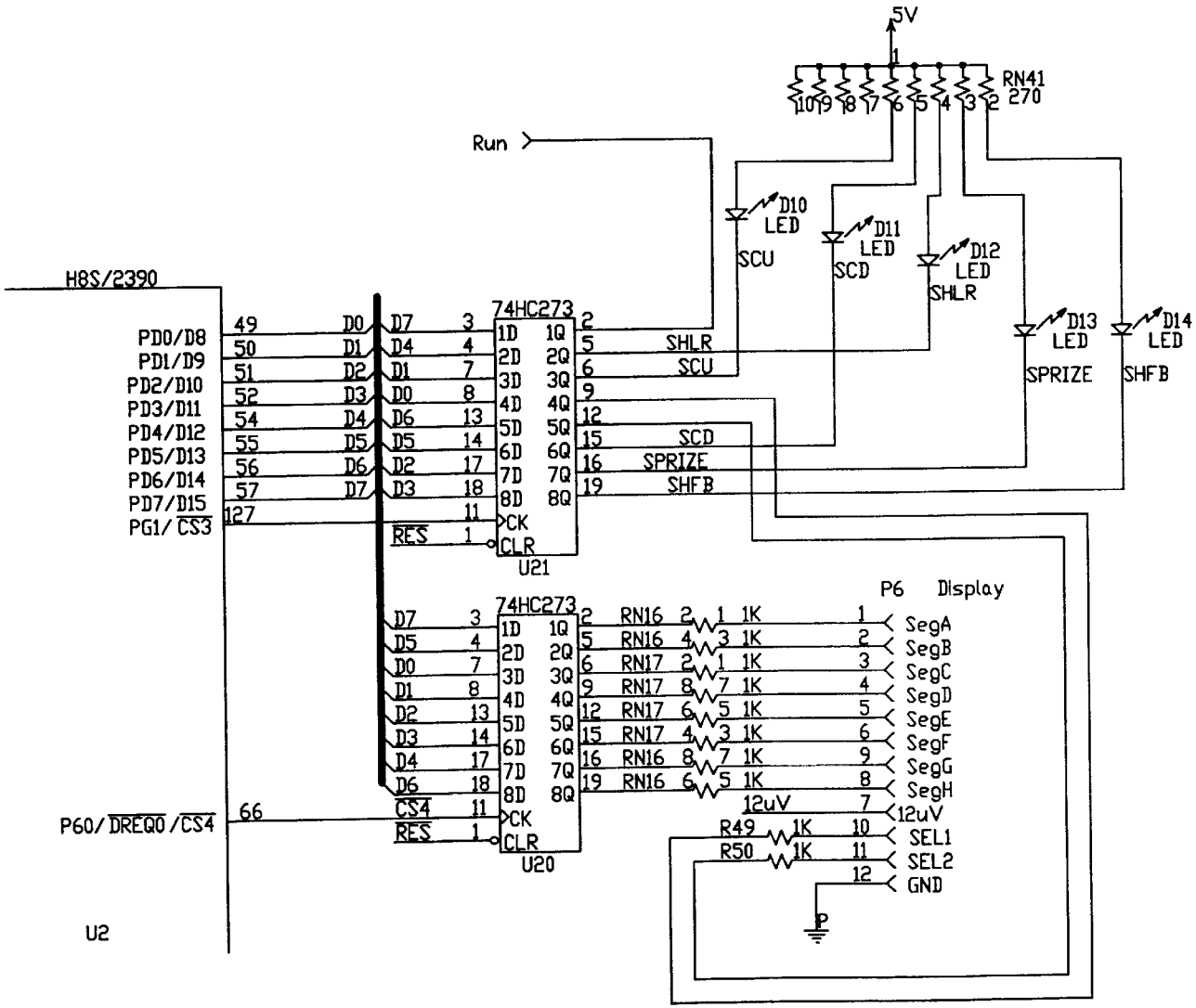
Figure 39:
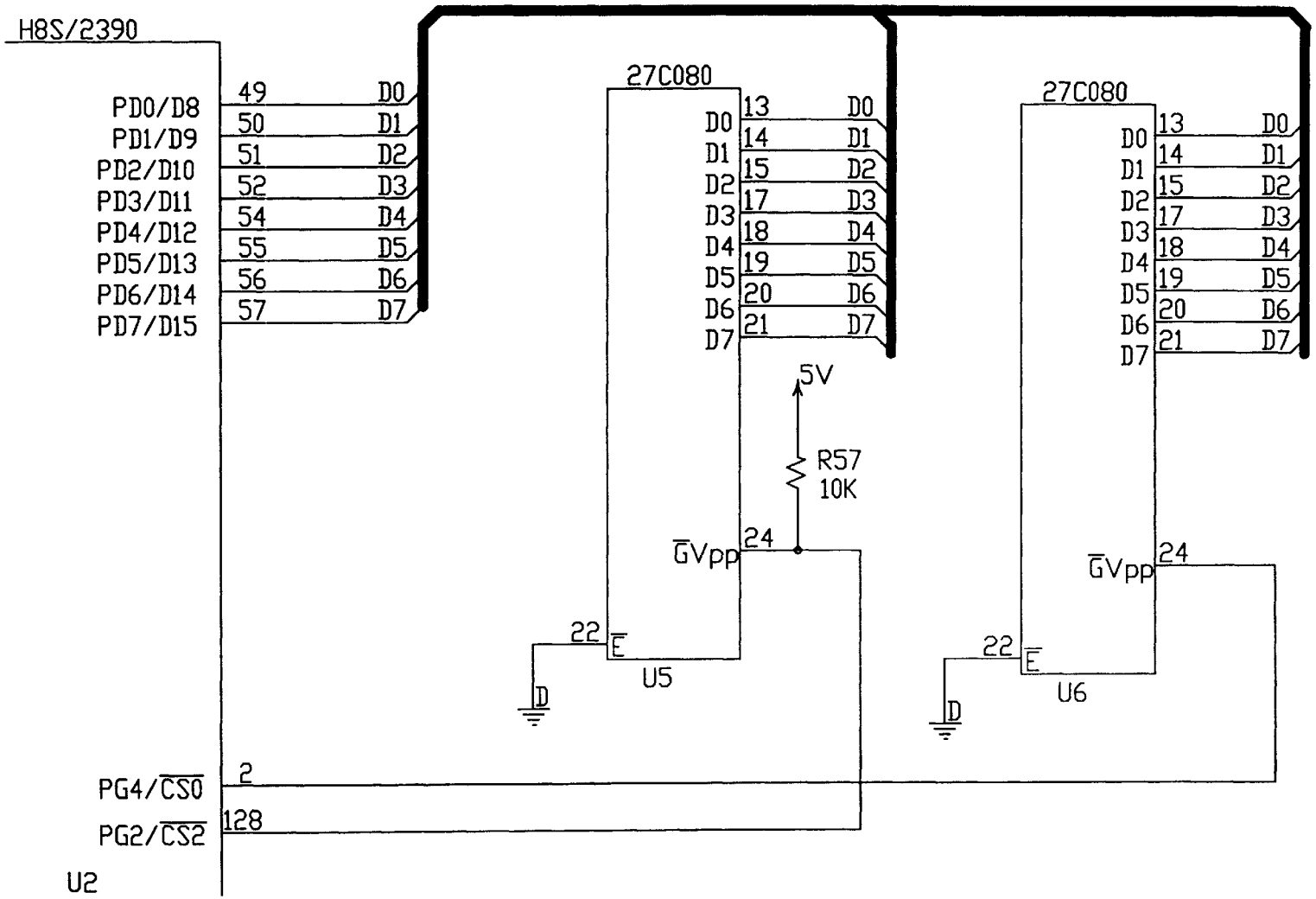
Figure 40:
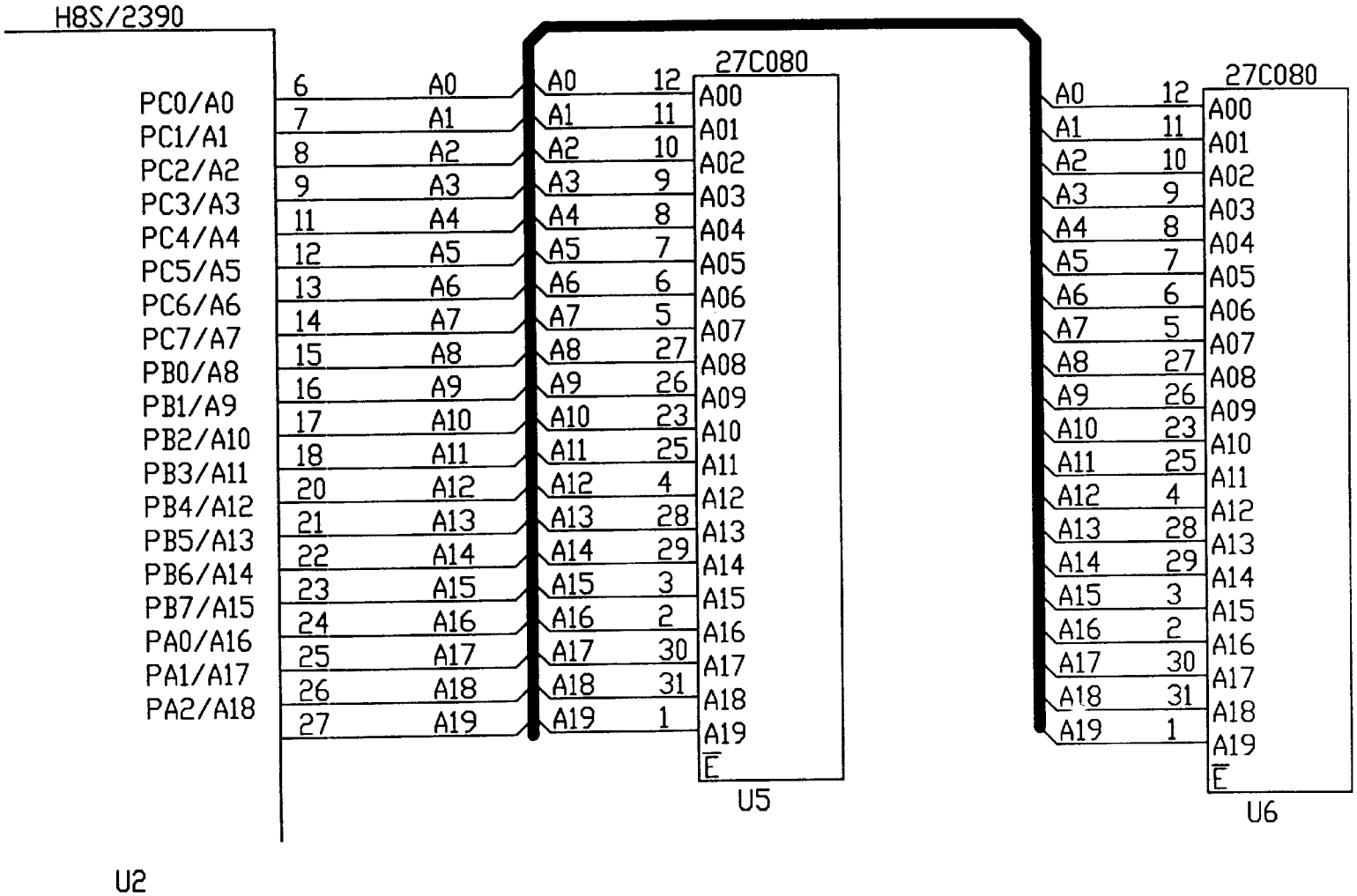
Figure 41:
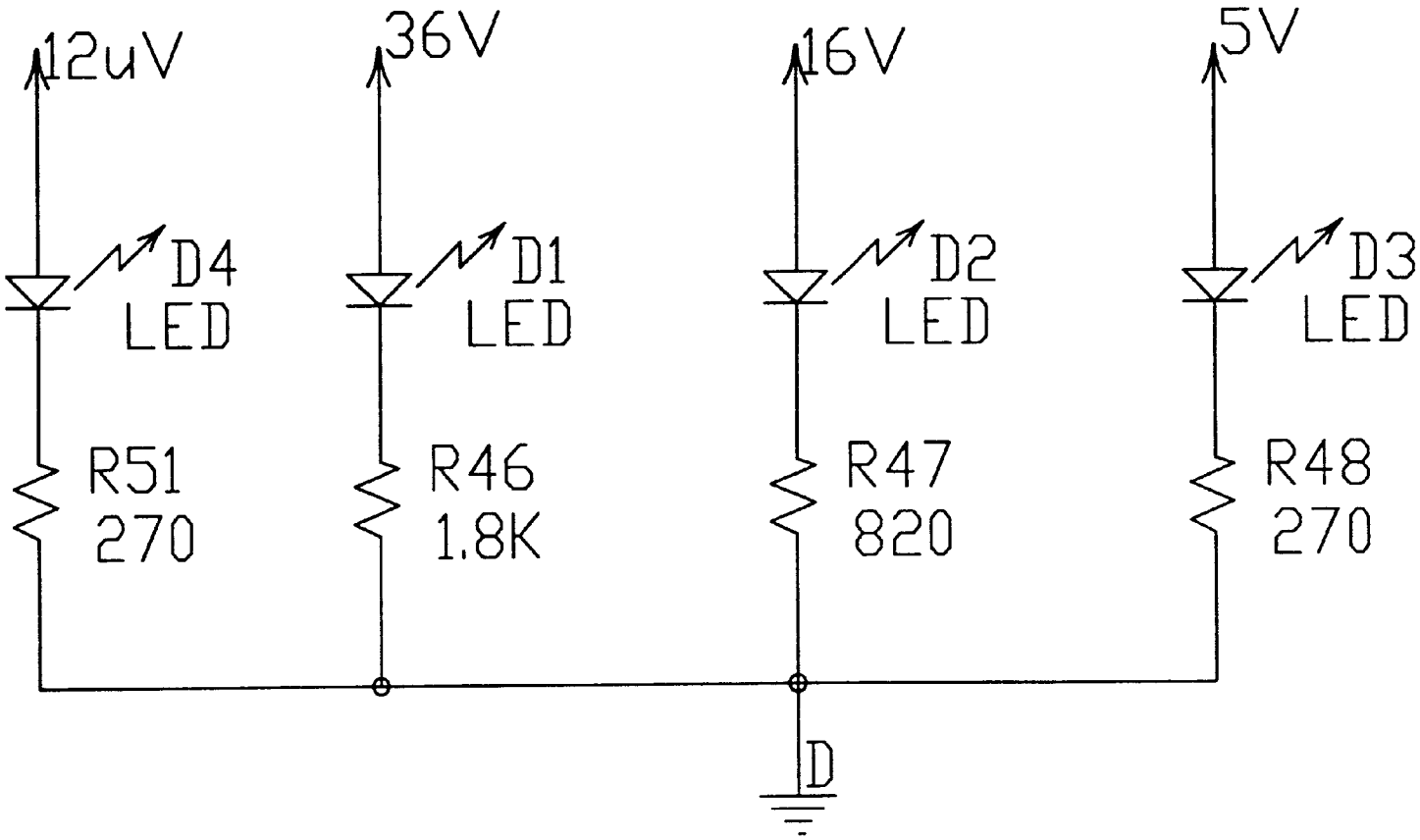
Figure 42:
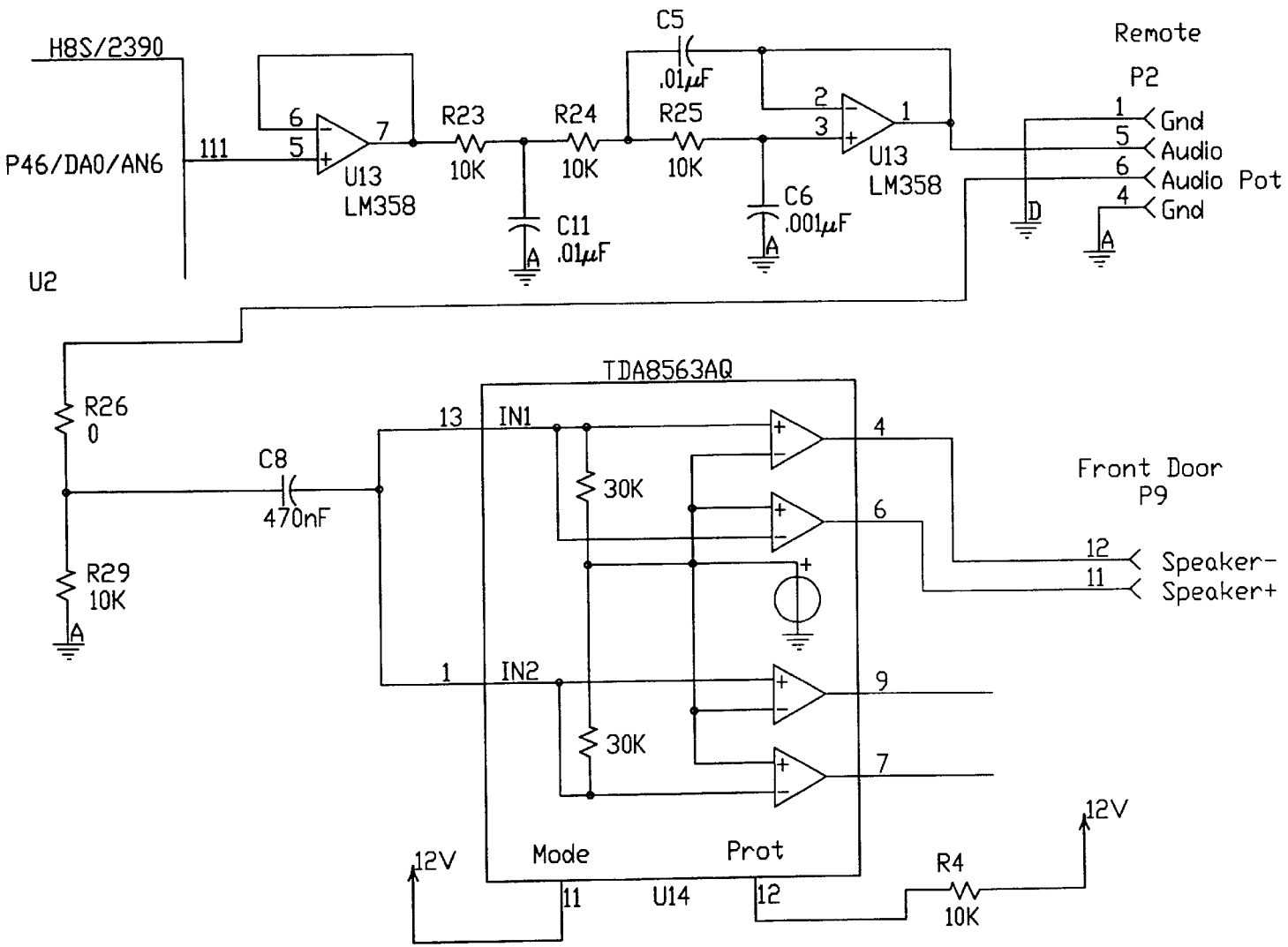
Figure 43:
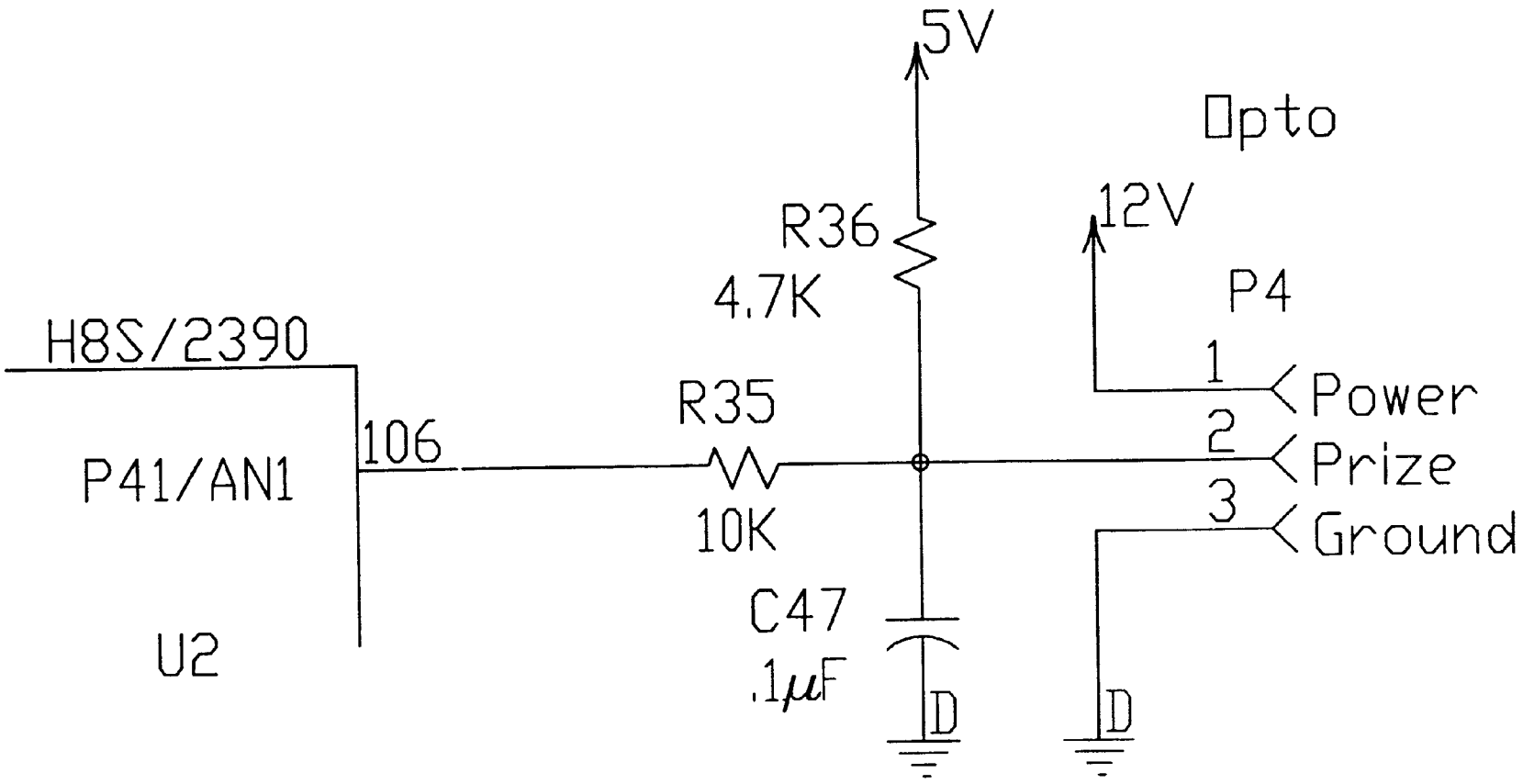
Figure 44:
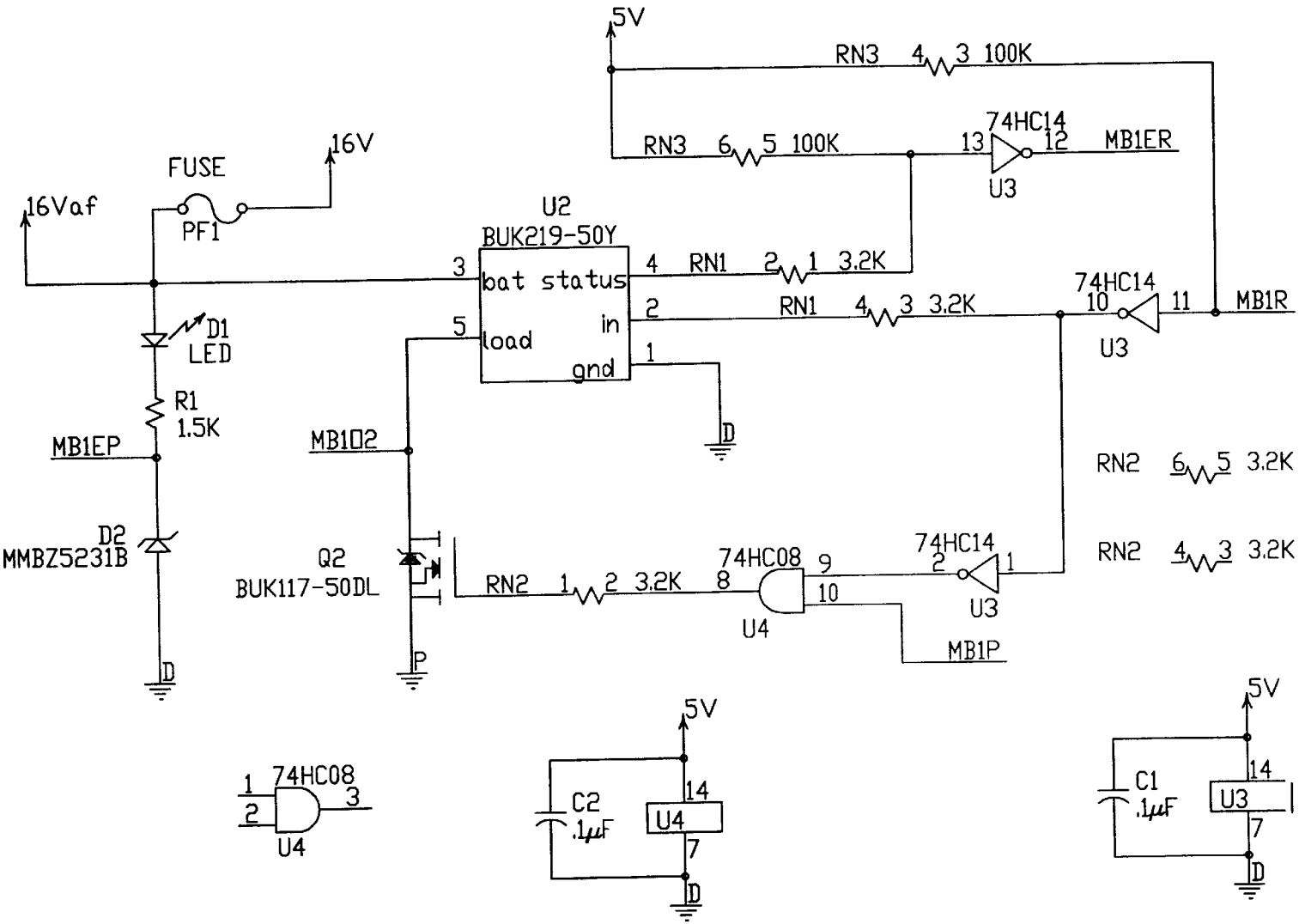
FIG. 44 and 45 are schematic diagrams of one of two identical electronic motor drive circuits of the invention, which circuit is, in a preferred embodiment, located on a "daughter" board, one of which boards controls the front/back motor and the other of which controls the up/down motor.
Figure 45:
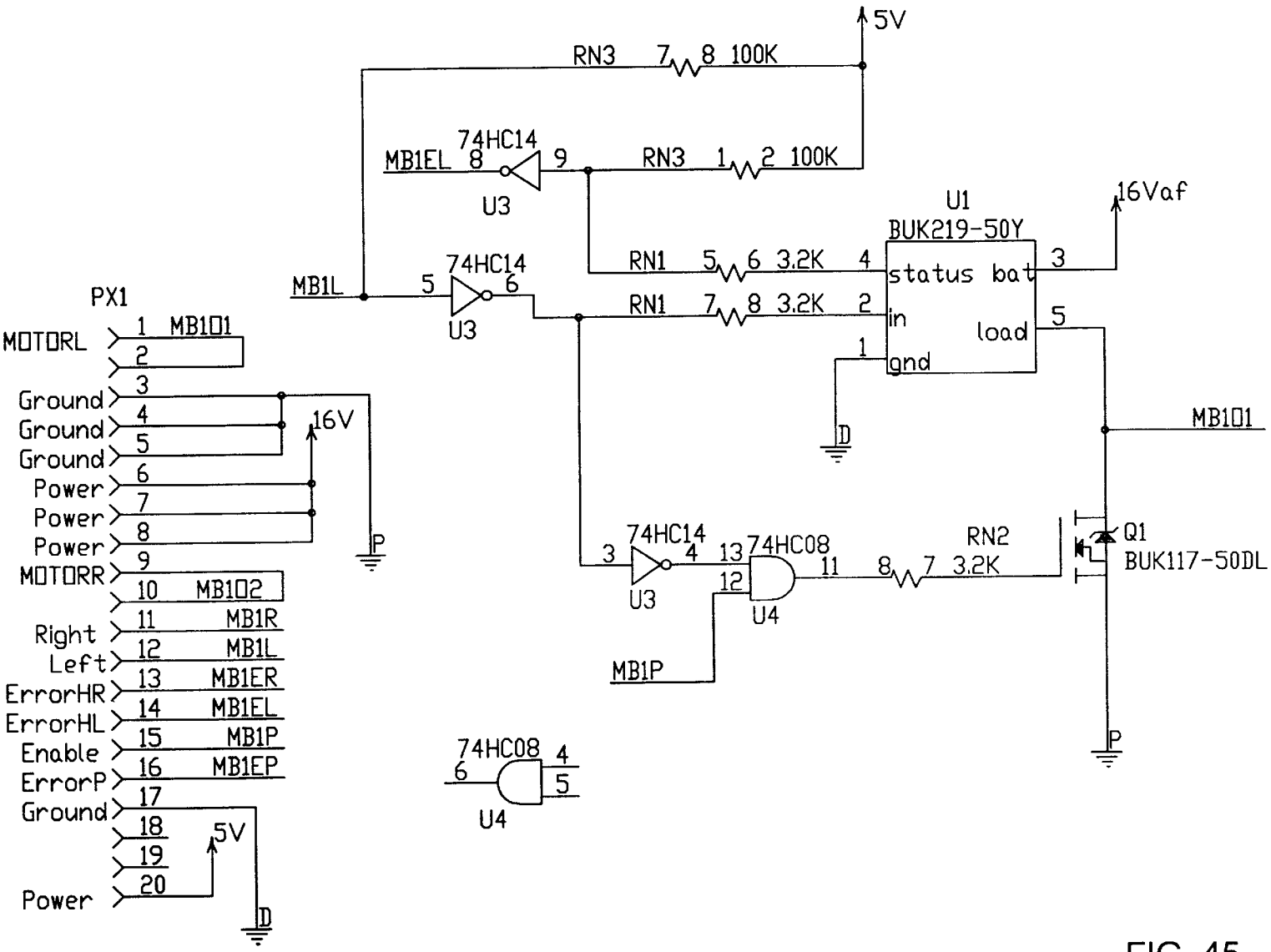
Figure 46:
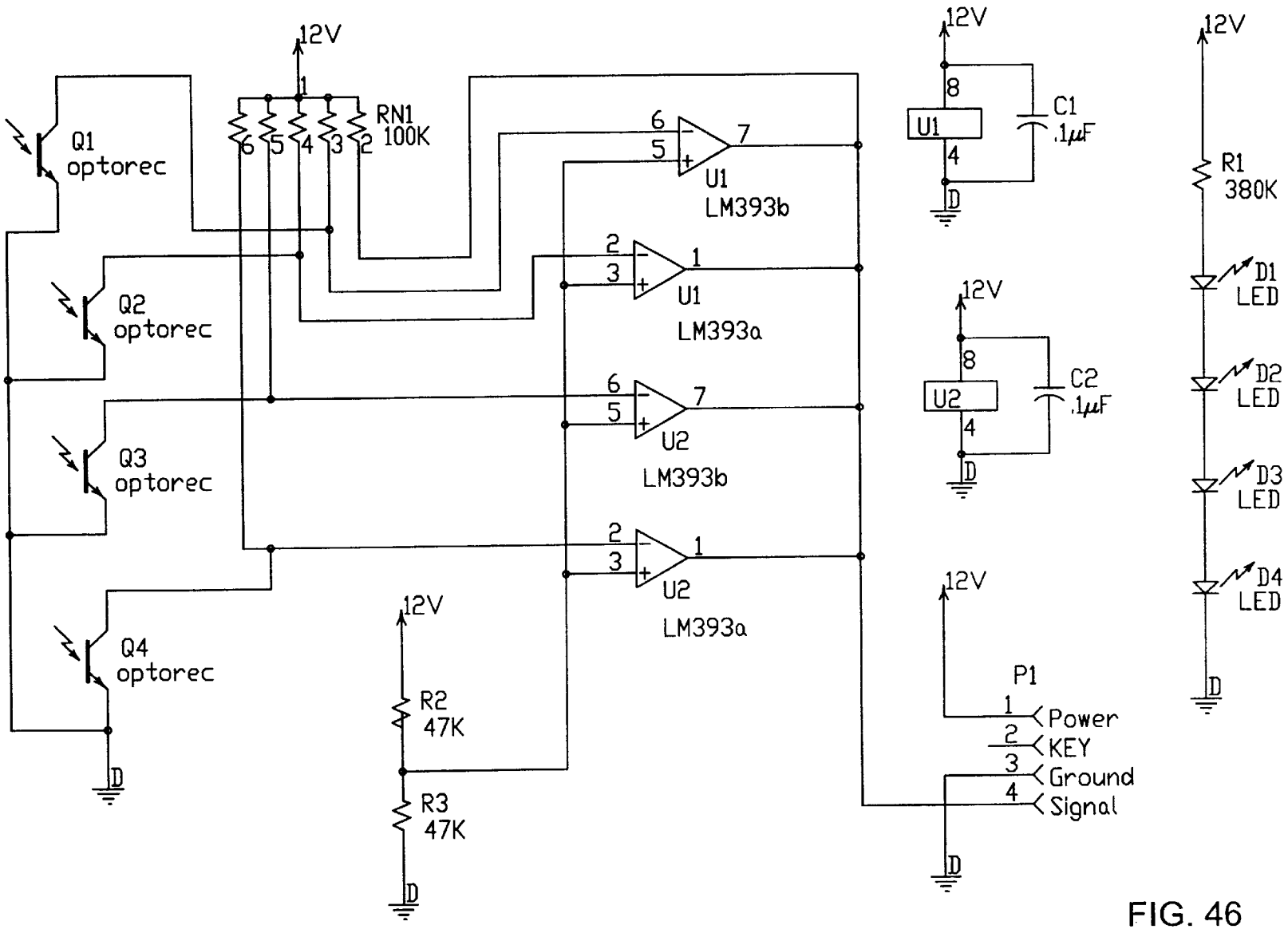
FIG. 46 is a schematic diagram of the prize sensor circuit of the present invention; and, FIG. 47 and 48 are schematic-diagram of the display board of the invention.
Figure 47:
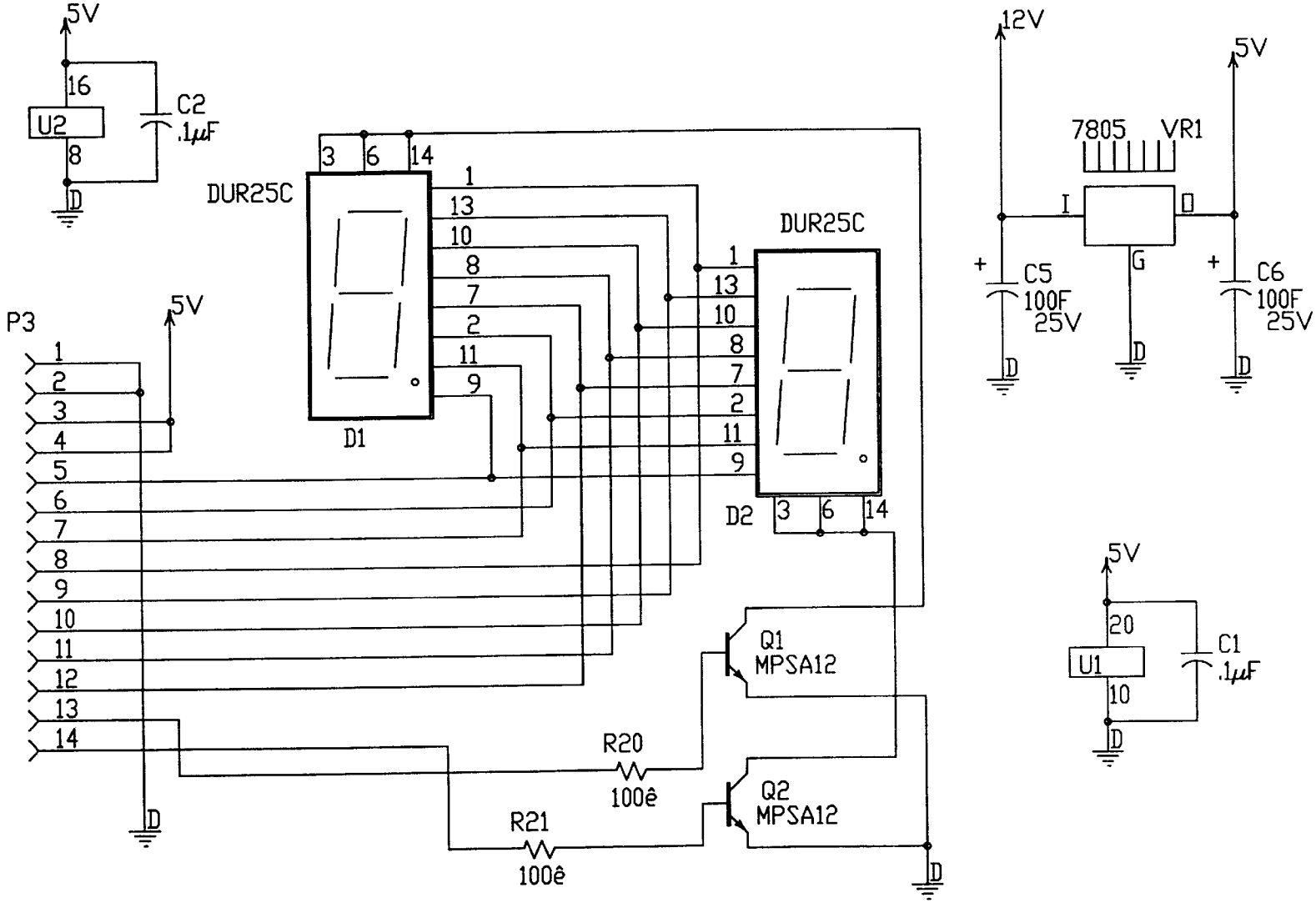
Figure 48:
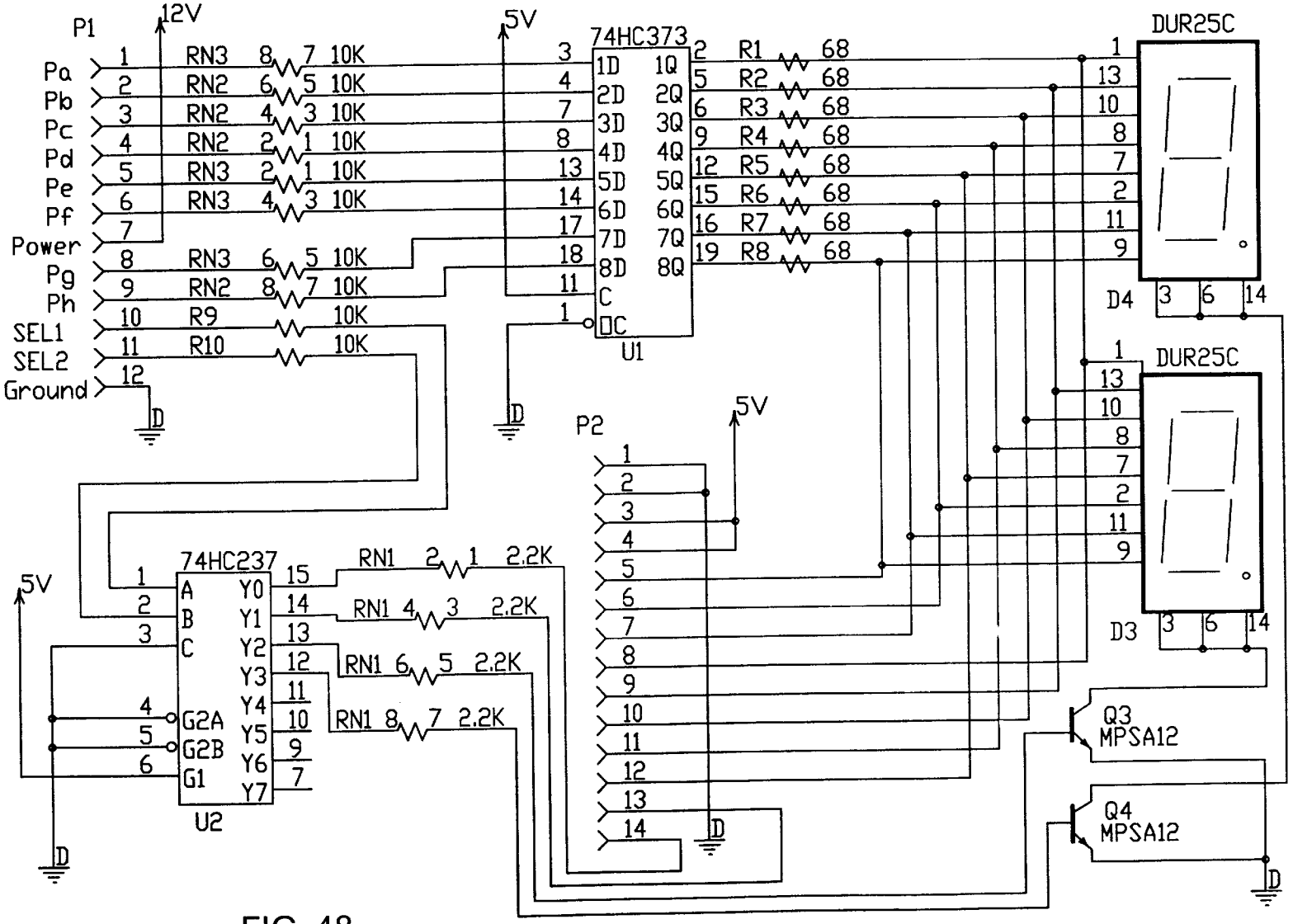
Figure 49:
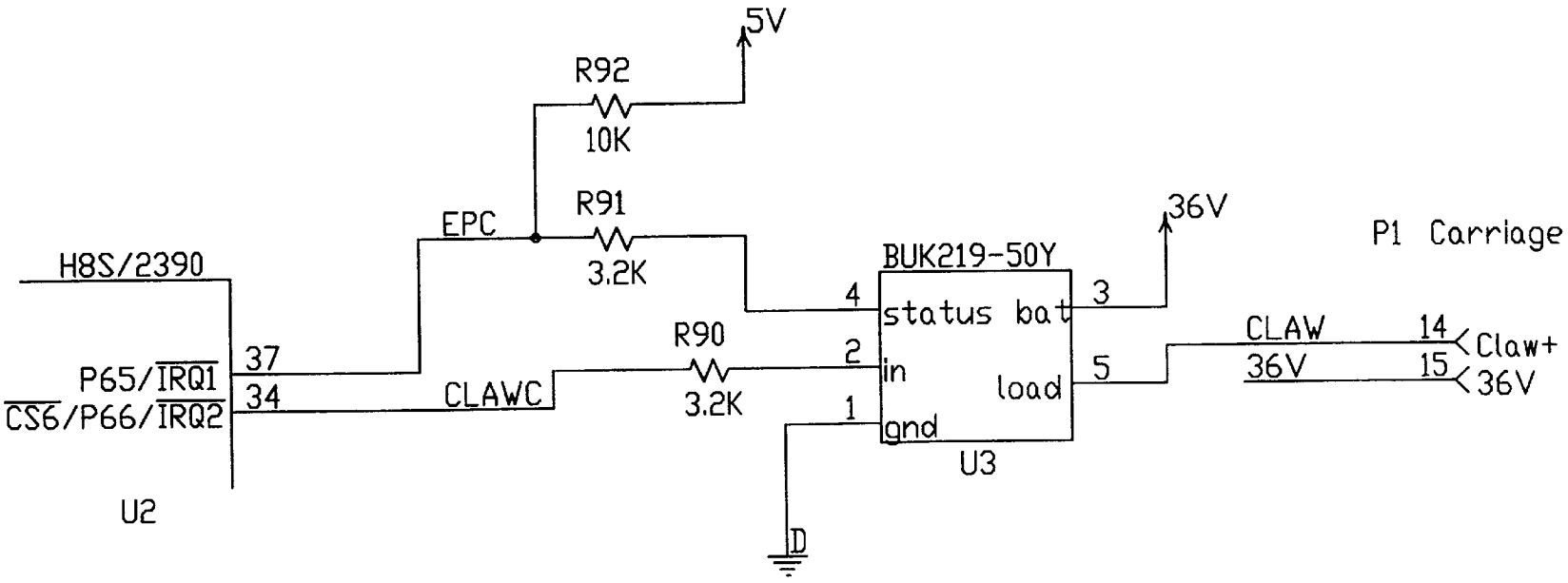
Figure 50:
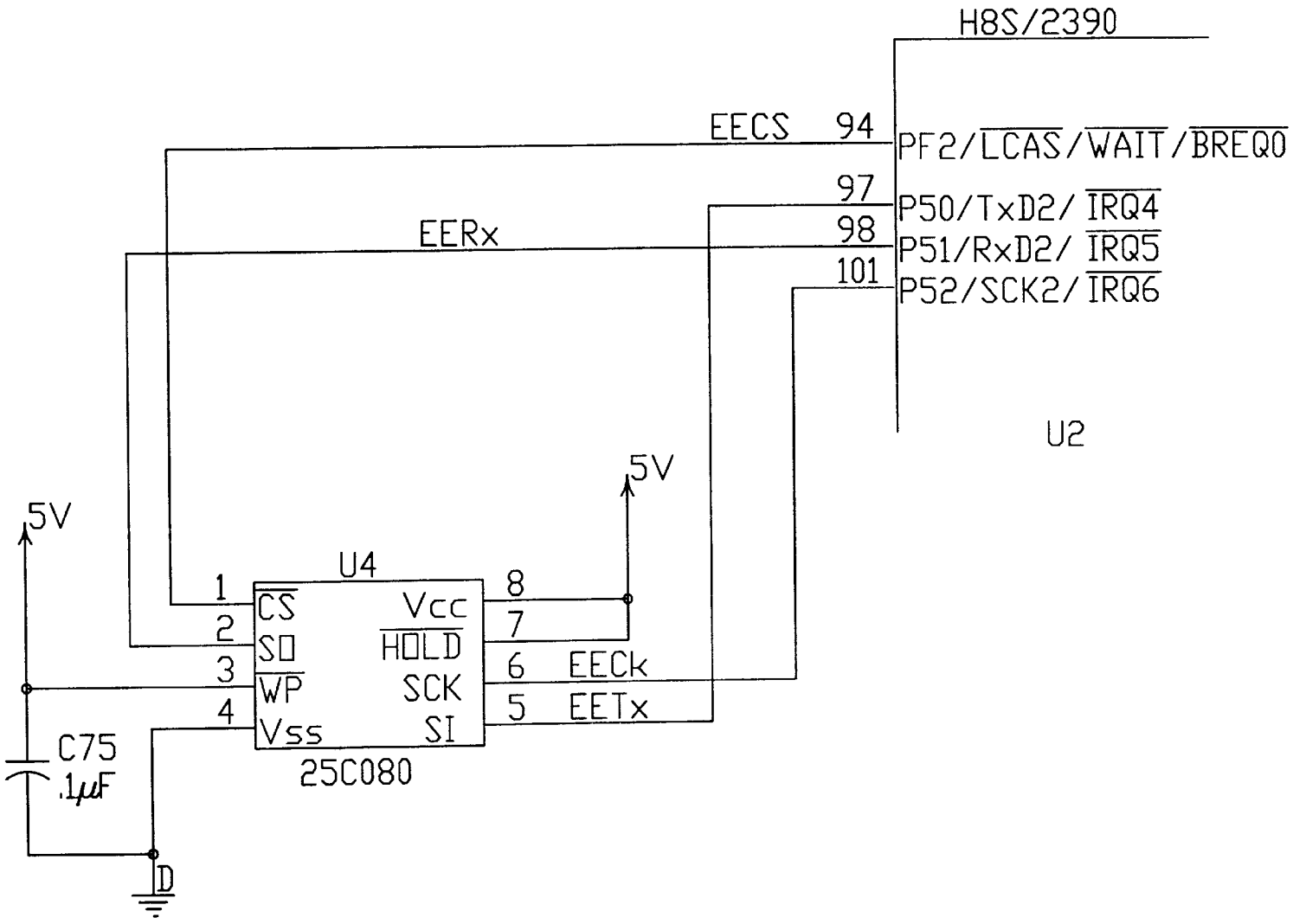
Figure 51:
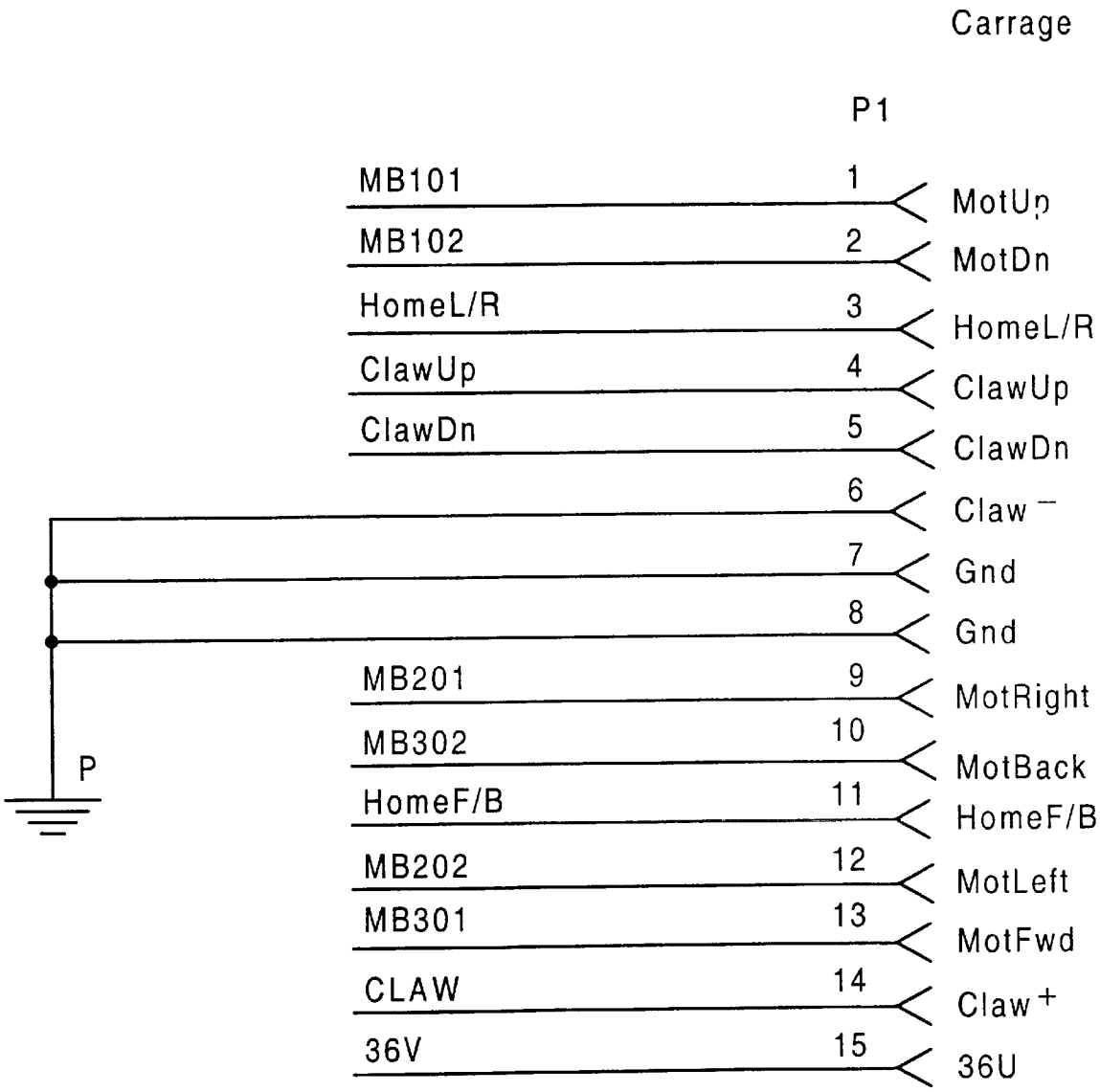

As shown in FIG. 35, coil housing 82 and coil cap 80 are operatively arranged for encasing coil 81, which receives electronic communications signals from claw cord 84. Attached to coil cap 80 by means of a knot is nylon cable 52. Located proximate top edge of coil housing 82 is a notch for passing claw cord 84, which connects to crane 40. Claw interconnect holder 86 is adjustably secured on the outer surface of coil housing 82. Claw interconnect holder 86 loosely secures a plurality of claw interconnects 87. Claw interconnects are operatively arranged for attachment to claw interconnect holder 86 as well as claw fingers 88. Plunger 90 is operatively arranged for slidable movement within coil 81 and spring 91. Plunger 90 is also secured to claw spider 94 by means of a bolt. Spring 91 is operatively arranged to act on upon coil 81 and washers 92 and 93. Claw fingers 88 attach to claw spider 94 at their distal ends. The attachment of claw fingers 88 to claw spider 94 and claw interconnect holder 86 via claw interconnects 87 form a structure capable of opening and closing under electromagnetic and opposing spring 91 forces.

Mechanical Operation

The rotational, translational and vertical movement of the gantry, the crane assembly, and the claw assembly in the modified polar-coordinate system will now be more fully explained to enable a person having ordinary skill in the art to use the invention.

Figure 7A:
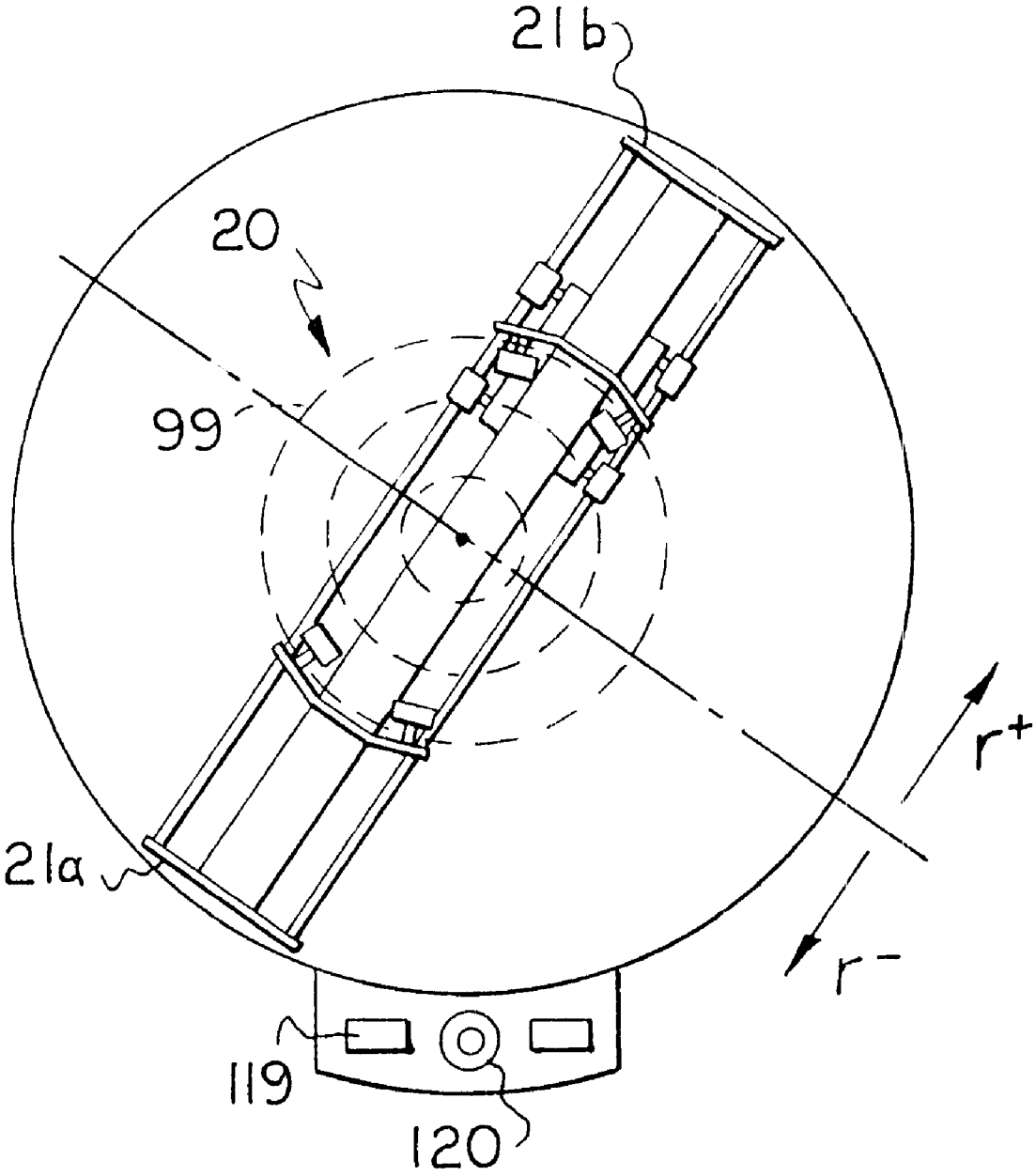
FIG. 7A is a top view of the gantry shown in FIG. 3, illustrating the r-θ-Z polar coordinate system which defines movement of the gantry, crane and claw of the present invention.
Figure 7B:
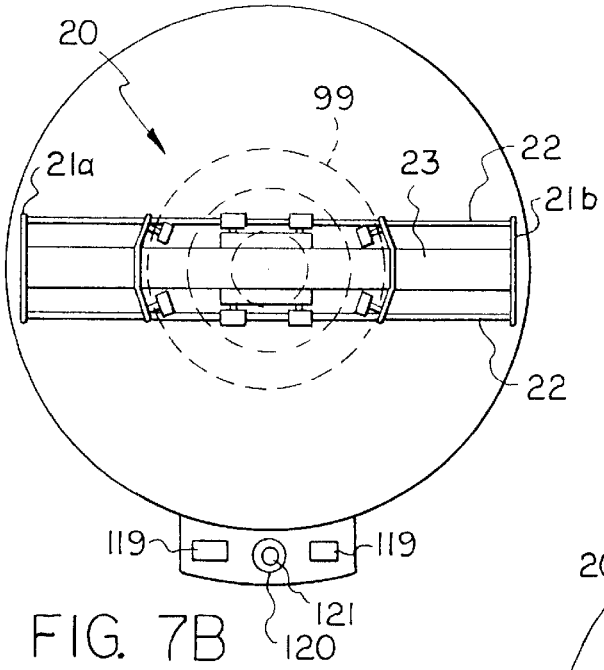
FIG. 7B is a top view of the gantry shown in FIG. 3, superimposed in position in the crane cabinet in the "rest" position, prior to insertion of a coin and start of a game.
Figure 8:
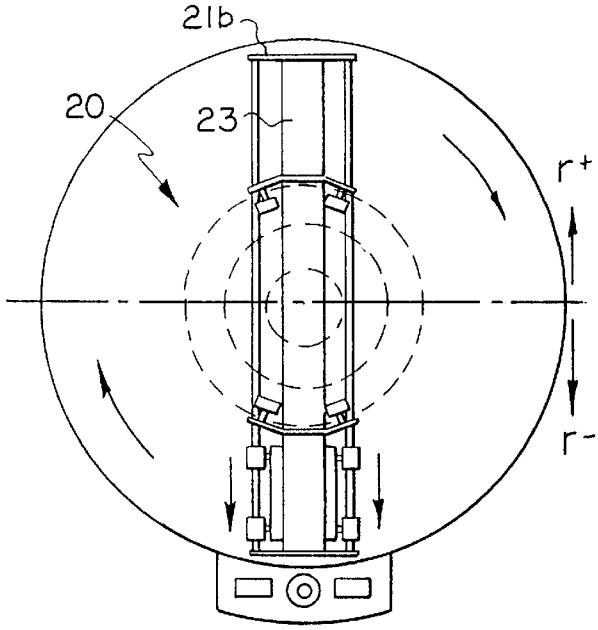
FIG. 8 is a view similar to that of FIG. 7B, but with the gantry in a "coinp-up" position 90° counterclockwise with respect to the rest position show in FIG. 7B; which coin up position is assumed immediately after insertion of a coin and start of a game.

FIG. 7B generally shows gantry 20 and crane assembly 40 in the "rest" position such that gantry 20 is positioned perpendicularly to a player facing control panel 50. Located proximate center in the "rest" position is crane assembly 40. As shown by FIG. 8, placing a pre-described amount of money into coin mechanism holder 33 or dollar bill validator 34 activates the crane game such that gantry 20 swings in a counter-clockwise direction and crane assembly 40 moves translationally in a r– direction to assume the "coin-up" position. For purposes of illustrating the modified polar coordinate system we use the "rest" and "coin-up" positions to describe rotational and radial movement of gantry 20 and crane assembly 40.

Adverting now to FIGS. 7–12, which show top views of the rotational movement of gantry 20 and the translational movement of crane assembly 40 under direction from a player using joystick 120.

Rotational Movement of the Gantry

Figure 9:
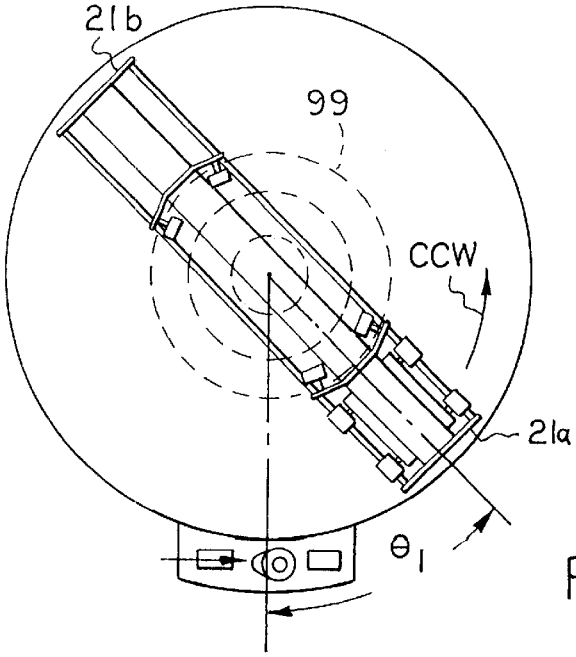
FIG. 9 is a view similar to that of FIG. 8, but with the gantry rotated in a counterclockwise direction relative to the coin up position of FIG. 8.
Figure 10:
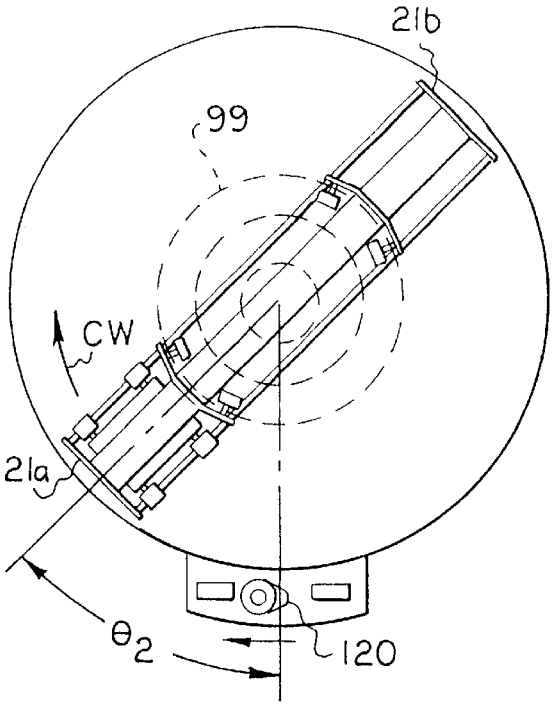
FIG. 10 is a view similar to that of FIG. 8, but with the gantry rotated in a clockwise direction relative to the coin up position of FIG. 8.

Rotational movement of the gantry and the crane assembly about cylindrical cabinet 140 is provided by means of motor 101 which engages motor coupler 102 secured to gantry separator 23. Rotation of the gantry is directed by means of joystick 120. As shown in FIGS. 9 and 10, from the "coin-up" position, movement of joystick 120 to the right or left causes gantry 20 to swing in respective counter-clockwise and clockwise directions about angles $\theta_1$ and $\theta_2$, respectively.

Translational Movement of the Crane Assembly

Translational movement of the crane assembly is provided by means of front/back motor 43 which engages front/back axle 155. Crane wheels 48 are secured to front/back axle 155 to provide translational movement of crane assembly 40 along parallel rails 22 of gantry 20. As shown in FIG. 22, O-ring belts 49 are provided such that all of the crane wheels are capable of coordinated movement.

Figure 11:
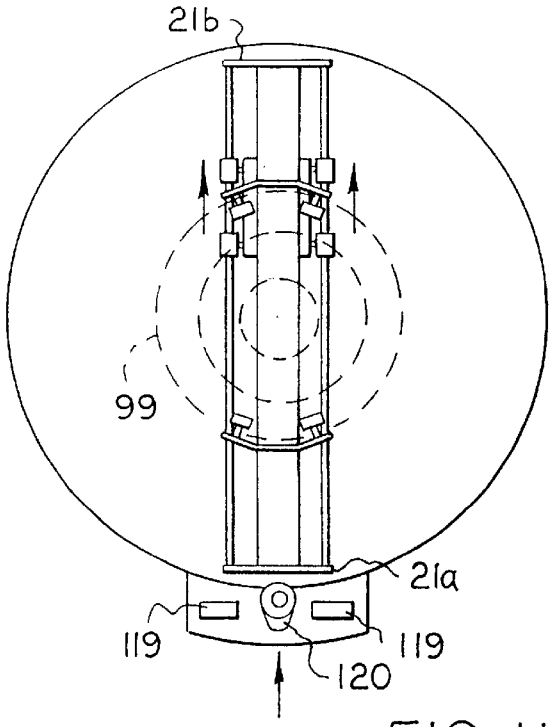
FIG. 11 is a view similar to that of FIG. 8, but showing the crane moving translationally toward the back of the game cabinet of the invention.
Figure 12:
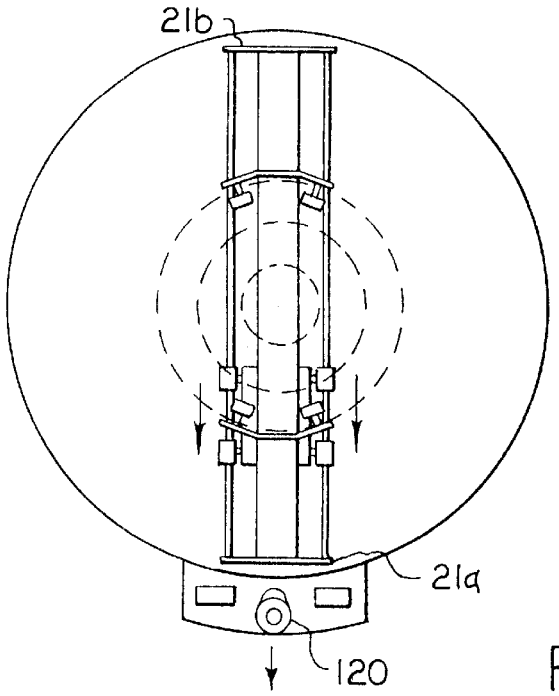
FIG. 12 is a view similar to that of FIG. 11, but showing the crane moving translationally toward the front of the game cabinet.

As shown in FIG. 11, from the "coin-up" position movement of joystick 120 in a direction away from the player causes the crane assembly to move away from the player in an r+ direction. By contrast, from the position of the crane assembly shown in FIG. 11, movement of the joystick toward the player causes the crane assembly to move toward the player in a r− direction as shown in FIG. 12.

It should be appreciated that the gantry and the crane assembly of the present invention are wholly capable of simultaneous movement about an angle θ and a positive or negative radius r as shown in FIG. 7*a*.

Vertical Movement of the Claw Assembly

Vertical movement of the claw assembly in the z direction is generally provided by up/down motor 44 which turns up/down axle 155 for raising or lowering nylon cable 52. As shown in FIGS. 13–15, when a player presses joystick button 121 a signal is sent to up/down motor 44 instructing the motor to lower the claw assembly in a Z− direction. In the preferred embodiment, pressing joystick button 121 causes claw assembly 79 to automatically lower until it is prompted for raising. However, while in a preferred embodiment pressing the drop button 121 causes the nylon cable to lower until it is raised, it should be appreciated that the joystick button can be configured to lower the claw assembly in an intermittent fashion.

Figure 26A:
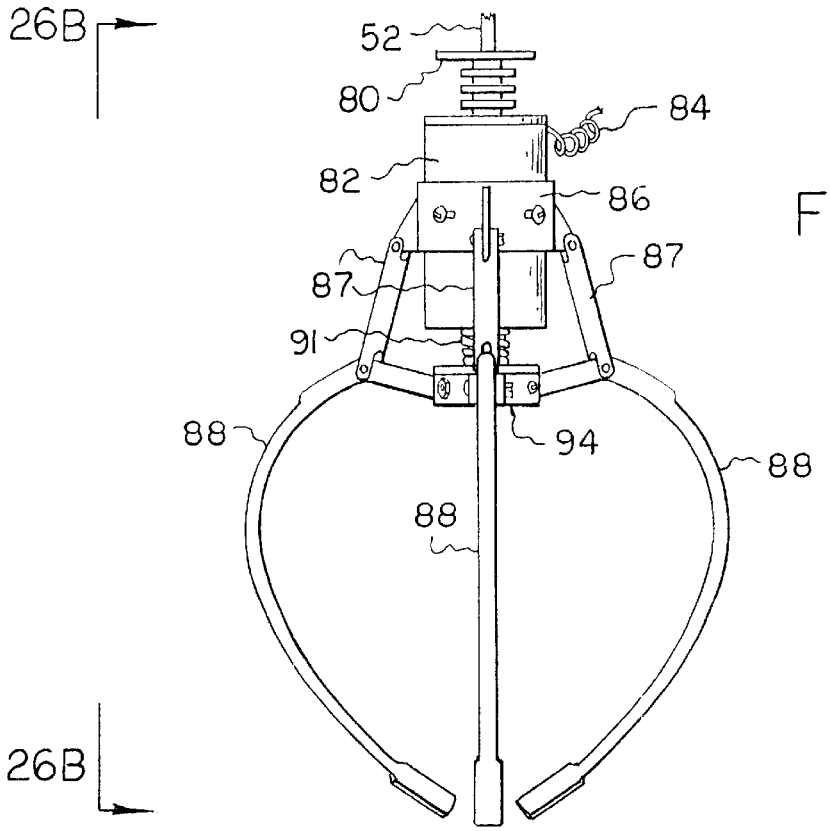
FIG. 26A is a side view of the claw assembly in the contracted or energized position.
Figure 26B:
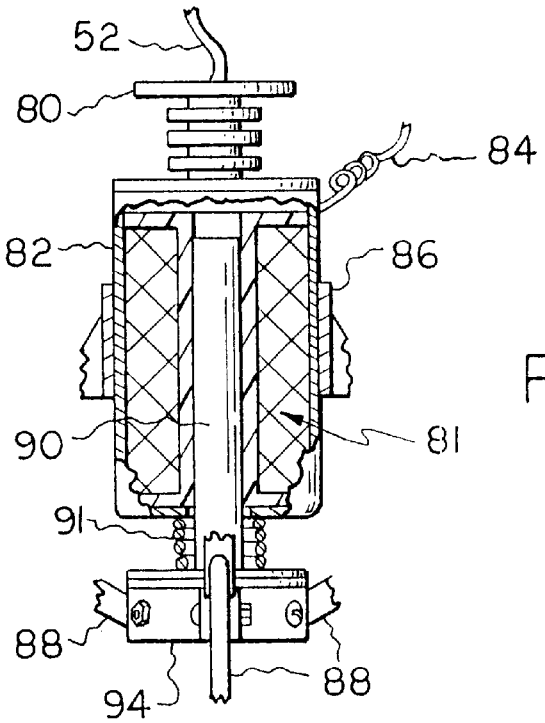
FIG. 26B is a side view of the claw assembly showing the plunger and spring of the claw assembly in the contracted position, which view is taken generally along line 26—26 of FIG. 26A.

FIGS. 23 and 24 are side views of the crane assembly generally taken along line 23—23 of FIG. 21 and shows the means by which the claw assembly is raised in the Z+ direction. As shown in FIG. 24, despite the opposing effects of spring 56, crane cable lever is capable of maintaining a "raised" position when the claw assembly is suspended in mid-air. This effect is due to the weight of the claw assembly "pulling" on the nylon cable. As shown in FIG. 23, when the claw assembly is lowered to secure a prize and comes into contact with a prize or the prize platform, the weight of the claw assembly is removed such that it no longer "pulls" on the nylon cable. The lack of the "pulling" force removes the weight of the claw assembly from the nylon cable and causes slack to form such that spring 56 is allowed to act upon crane cable lever 54. The actuating action of spring 56 causes crane cable lever 54 to lower. When crane cable lever 54 is lowered, down actuator 58 contacts down sensor 57 of the coil stop block cover. As shown in FIG. 23, when contact between the down sensor and the down actuator occurs, the claw assembly is signaled to contract as shown in FIGS. 26*a* and 26*b*. After contraction of the claw assembly and passage of a preprogrammed period of time, the up/down motor is signaled to turn up/down axle 155 for raising the nylon cable and attached claw assembly 79 as shown in FIG. 14.

As shown in FIGS. 14 and 24, claw assembly 79 continues to ascend until contact with coil stop block 63 occurs. As shown in FIG. 24, when claw assembly 79 contacts coil stop block 63, springs 66 are compressed such that contact between up sensor 61 and up actuator 62 occurs. Contact between the up sensor and the up actuator signals the up/down motor to turn off and the crane assembly to go to the "translational home" position as shown in FIG. 15. Upon reaching the "translational home" position the claw assembly, after a preprogrammed period of time, is signaled to relax and to drop any secured prizes into the prize ejection chute as shown in FIG. 15. After dropping any prizes the gantry and crane are signaled to return to the "rest" position as shown in FIG. 16.

Claw Operation

Figure 27A:
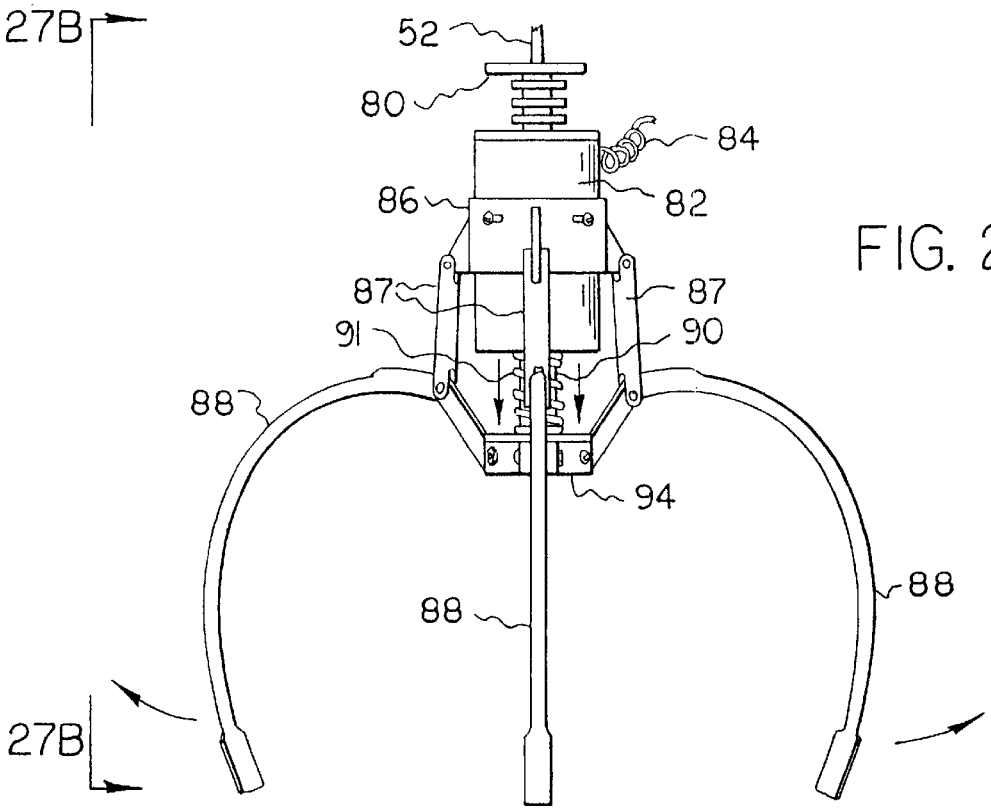
FIG. 27A is a side view of the claw assembly in the relaxed position.
Figure 27B:
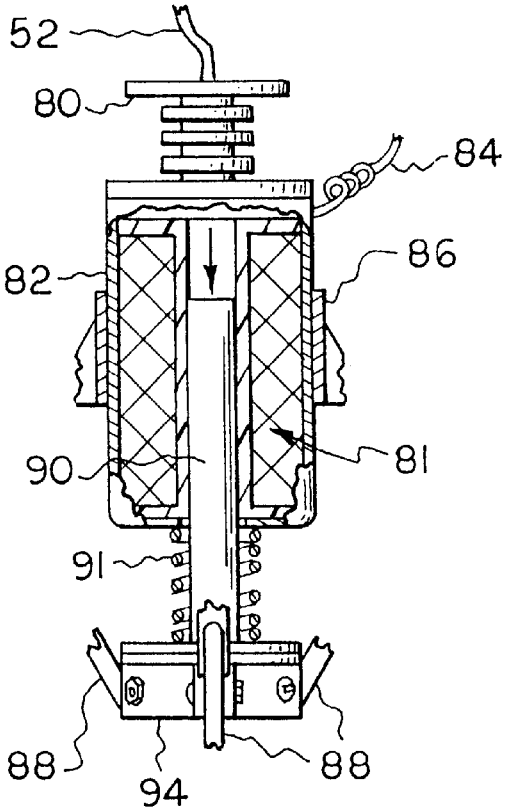
FIG. 27B is a side view of the claw assembly showing the plunger and spring of the claw assembly in the relaxed position, which view is taken generally along line 27—27 of FIG. 27A; and, FIG. 28–43 and 49–51 are schematic diagrams of the electronic control "mother board" circuit of the invention.

Referring now to FIGS. 26*a*–27*b*, which show side views of the claw assembly of the present invention. FIGS. 26*b* and 27*b* are views taken generally along lines 26 and 27 of FIGS. 26*a* and 27*a*, respectively. As shown in FIGS. 26*a*–27*b*; when a current is passed through coil 81, the attraction of plunger 90 causes claw spider 94 to move in the direction of plunger 90, compressing spring 91. Movement of the claw spider in direction of the plunger acts upon the claw interconnects and the claw fingers, such that contraction of the claw fingers occurs. Contraction of the claw fingers provides a means by which prizes may be secured as shown in FIG. 17.

As shown in FIGS. 27*a* and 27*b*; when current has ceased to pass through the coil, the electromagnetic effect upon the plunger is cancelled and the spring is allowed to decompress. Decompression of the spring acts on coil 81 and washers 92 and 93, which causes the plunger and claw fingers to relax. It should be appreciated that washer 92 comprises a rynite washer which is provided for breaking up any residual magnetic field. In addition, it should be appreciated that washer 93 is provided to act as a claw finger stop, preventing the claw fingers from being raised too high in the relaxed position.

As shown in FIG. 15, after being signaled to ascend and after the claw assembly reaches the "translational home" position above the prize ejection chute, the claw assembly is signaled to relax such that a secured prize is allowed to fall into the prize ejection chute for receipt by a player. Upon completion of the game, gantry 20 returns to the "rest" position, as can be seen in FIG. 16.

Electronic Circuit Diagram

Figure 28:
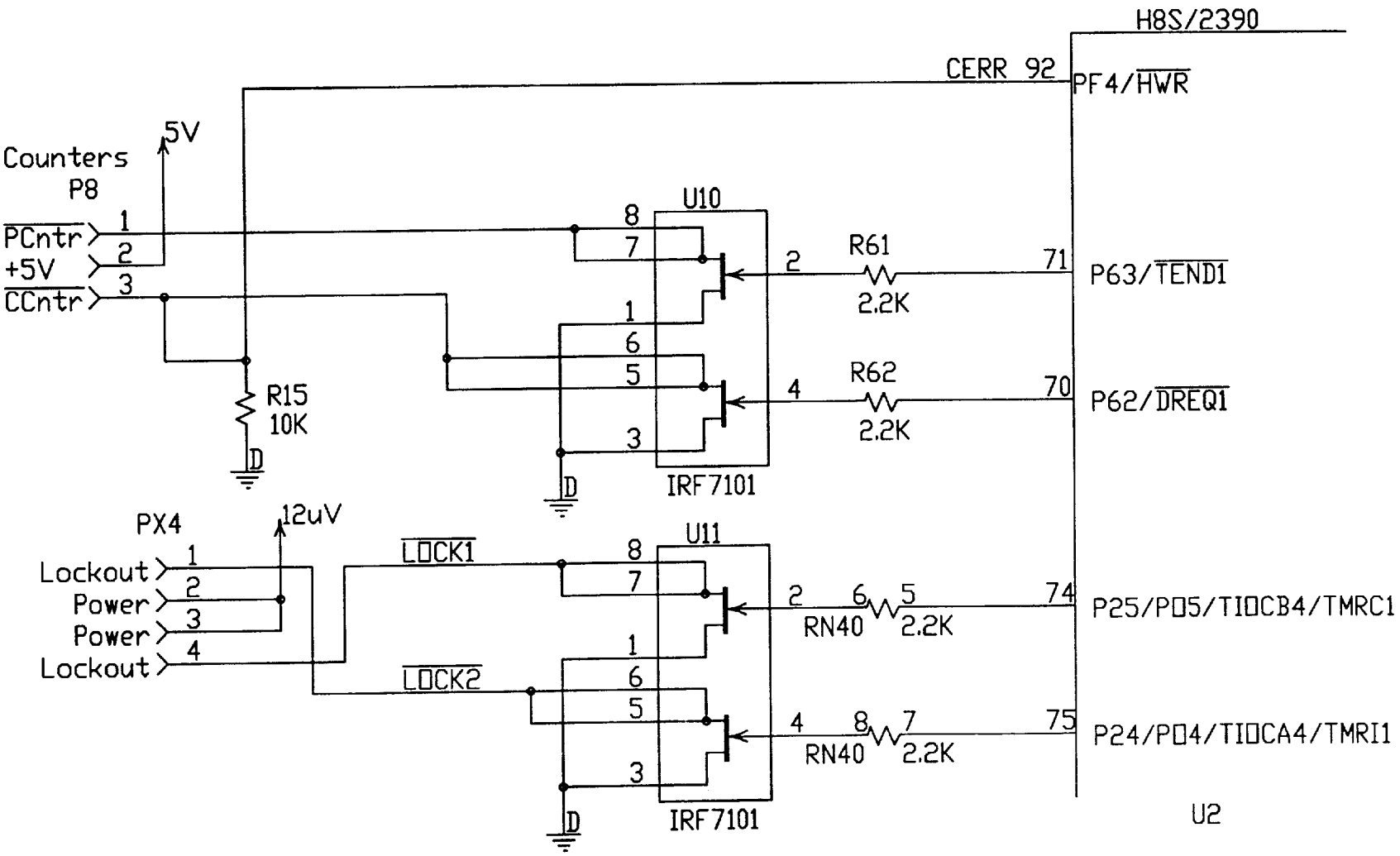

Main electronic control circuit 200 of the invention is shown in FIG. 28. The game is microprocessor controlled, and, in a preferred embodiment, microprocessor U2 is Hitachi model H8S/2390, or equivalent. The code for the microprocessor is stored in EPROMS U5 and U6, which, in a preferred embodiment are both EPROM model 27CD80. Connected to the EPROMS are latches U20 and U21 (model 74HC273, or equivalent) which ensure proper processing of the output signals to external devices, as is well known in the art. (A latch is a type of flip-flop that accommodates the settling of data received from the microprocessor.)

Power supply section 210 of the circuit broadly comprises four bridge rectifier circuits and a plurality of voltage regulators as described below. Alternating current at 120V is reduced by a transformer (not shown) to 36 VAC, which enters the main circuit board at connector P10. This AC supply voltage is provided via fusible links to a plurality of bridge rectifier to produce pulsed DC voltages at a plurality of different DC voltage levels: namely, a 16V unregulated source provided by bridge rectifier DB1; a 36V regulated source provided by bridge rectifier DB2 and voltage regulator VR3; a regulated 12V source provided by bridge rectifier DB3 and voltage regulator VR1; a regulated 5V source provided by bridge rectifier DB3, voltage regulator VR1, and voltage regulator VR2; and a 12V unregulated source provided by bridge rectifier DB4. Each bridge rectifier includes a corresponding capacitor to filter and smooth the voltage waveform, as is well known in the art. In a preferred embodiment, voltage regulators VR1 and VR3 are high output model LM338K ICs, VR2 is a model LM7805.

The audio output section of the circuit broadly comprises all of the circuit elements shown in block 220 of the circuit diagram. Digital audio signals are initially stored in EPROMS U5 and U6. The audio signals include representations of various sounds used throughout play of the game, such as, but not limited to: background sound, sounds made when a coin is inserted, when a prize is won, when a prize is lost, when the claw is open, when the claw is closed, when the gantry/crane and/or claw is in motion, etc., as is well known in the art. The microprocessor includes an integral digital to analog converter, and provides an analog audio signal at pin 111. This audio signal is communicated to the non-inverting input of operational amplifier U13 (model LM358 or equivalent). U13 and its associated support circuitry (resistors and capacitors) comprise an active low-pass filter which filters and smoothes the analog audio signal. The audio signal next communicates via connector P2 with an audio potentiometer, which enables the user of the game to adjust sound volume levels. The volume-adjusted audio signal next enters power amplifier U14 (Philips model TDA8563AQ, or equivalent), where the signal is amplified before transmission to the speaker via leads SPKR− and SPKR+.

Inputs to Main Circuit

There are various input signals to the main circuit board from various sensors, switches, mechanical controllers, etc., of the invention.

The input signals enter the main board at various sections. Front door section P9 receives input signals JoyUp (joystick up), JoyDn joystick down), JoyRt (joystick right), JoyLt joystick left), JoyBtn (joystick button), Coin1 (coin slot 1), Coin2 (coin slot 2), and DBV (dollar bill validator). The "joystick up" position is toward the player; the "joystick down" position is away from the player. The "joystick right" position is toward the right of the player; the "joystick left" position is toward the left of the player. It is assumed for this description that the player is facing the front of the game. As the joystick is moved, appropriate signals are sent to the board at P9. As coins are inserted into either of the two coin slots, appropriate signals are sent to the board at P9. When a dollar bill is validated, an appropriate signal is sent to the board at P9.

Other input sections enter from the gantry (carriage) assembly at section P1. Section P1 receives input signals, HomeF/B (home front back), HomeL/R (home left right), ClawUp (claw up), ClawDn (claw down). The Home input signals indicate when the crane assembly is in its "home" position, and the Claw input signals indicate when the claw assembly has reached the top and bottom of its travel.

Another input enters the board at section P4, which comprises the prize detector input signal. A ticket dispensing signal enters the board at section P3, to indicate that the game has dispensed a redemption ticket (some jurisdictions require the dispensing of tickets when a player fails to win a prize with the claw). A door switch sensor signal enters the board at section P7. This signal indicates that the cabinet door has been opened, and the microprocessor acts upon this signal to disable the rotational movement of the crane to avoid injury. It should be apparent to those having ordinary skill in the art that the microprocessor could be programmed to disable the entire crane. A limit forward signal enters the board at section PX4. This signal indicates a forward limiting position of the crane.

Connectors PX1, PX2 and PX3 connect the main board to the up/down, rotational, and front/back motors, respectively, of the invention. Input signals ErrorHR, ErrorHL, and ErrorP enter the board at PX1 from the up/down motor drive daughter controller board to indicate various errors on the controller board. Input signals ErrorHR, ErrorHL, and ErrorP enter the board at PX2 from the rotational motor drive daughter controller board to indicate various errors on the controller board. Input signals ErrorHR, ErrorHL, and ErrorP enter the board at PX3 from the front/back motor drive daughter controller board to indicate various errors on the controller board.

Finally, with respect to input signals, connector P2 includes Program and Acct input signals to place the game in either a programming or accounting mode for operator use, as is well known in the art.

Output Signals

The connectors on the main board also include a plurality of output connections. Starting with P9, this connector includes outputs Speaker+ and Speaker− for the audio speaker connection. Connector P7 includes provisions for connecting light outputs at LBlink and RBlink. In connector P3, TRUN is an output signal line that tells the ticket dispenser to operate. Motor output control signals MotUp, MotDn, MotFwd, and MotBack at connector P1 control the claw up/down motor and the front/back motor, respectively. In operation, the microprocessor sends control signals to the respective daughter boards of the motors, the daughter boards send appropriate signals back to the main board (except for the rotational motor) at PX1 and PX3, and motor control signals leave the main board at P1 to control the motors. In the case of the rotational motor, the daughter board for this motor sends control signals directly.

Connector PX4 includes two lockout output signal connections (labeled "Lockout") to energize lockout coils to prevent coins from being accepted in the coin slots. For example, in certain jurisdictions, such as New Jersey and California, it is not permitted to allow the machine to build up credits, and the coin slot mechanism must be deactivated until the current credit is used. Connector P8 includes two output signal connections, PCntr, which is a "plush" or "prize" counter to count the number of prizes awarded, and CCntr, which is a coin counter signal. For example, an owner/operator of the game can use these signals to determine how many coins were taken in and how many prizes were awarded.

Finally, output display signal connections are made at connector P6. The game includes LED displays to indicate the number of credits remaining, as well as a time counter which, in a preferred embodiment, counts down as the game is in progress.

Miscellaneous Circuit Elements

Circuit element U1 is a reset circuit which functions to ensure that supply voltage to the processor is appropriate; otherwise the processor is disabled. Ceramic resonator Y1 provides a 20 MHz clock signal to the microprocessor. Q1 and Q2 are drivers for lights, which are optional. U3 is a drive transistor that provides power to the claw (at 36V).

Electrical Operation During Game Play

Prior to starting a game, the game is set to be in an "attract" mode. While in this mode, the game may be programmed to emit sounds, or display lights to attract players.

To commence a game, a player inserts money or tokens into the game in one of three ways. In a preferred embodiment, the money is inserted into either a first coin slot, a second coin slot, or the dollar bill validator. All of these devices, as indicated above, send appropriate signals to the motherboard from the front door via connector P9 (at pins 6, 14 and 10, respectively). These coin/dollars signals are active low signals (which means the signals go from +5V to ground). This signal is communicated to the microprocessor, which-senses the insertion of a coin, and initiates a "money insert" sound. Once the preprogrammed "cost of game" amount has been sensed by the microprocessor (it may take a plurality of coins to reach this amount), the game is started. Once the game is activated the microprocessor sends appropriate signals to connector PX4 to turn off the lockout devices. If lockout coils are attached, they prevent any further coins from being inserted. This is required in certain jurisdictions.

At this point, the game starts to play background music, if preprogrammed to do so, and the gantry and crane centers itself in the "coin-up" position. The music is stored in a digital format in the EPROMs, converted to analog signals in the microprocessor and output at pin 111 (AUDIO) to the audio amplifier (U13). In a preferred embodiment, the "centering" position of the gantry, crane and claw is shown in FIG. 8, although this position is programmable. Centering is accomplished by rotational and translational movement of the gantry and crane, which motor control will become clear from the following description of circuit operation during game play.

During game play, the player moves the joystick in the general direction that she wishes the claw to move. The joystick is coupled to sensing switches that, in turn, send signals to the main board. The microprocessor interprets and processes these signals and send appropriate control signals to control the claw motor, rotational (gantry) motor, and front/back motor, respectively. To control the claw motor, appropriate enabling and directional signals are sent from the microprocessor to connector PX1, which, in turn, sends appropriate Z+ and −z control signals to the claw motor daughter control board. To control the rotational motor, appropriate enabling and directional signals are sent from the microprocessor to connector PX2, which, in turn, sends appropriate clockwise (cw) and counterclockwise (ccw) control signals to the rotational motor daughter control board. To control the front/back motor, appropriate enabling and directional signals are sent from the microprocessor to connector PX3, which, in turn, sends appropriate r− and r+ control signals to the front/back motor daughter control board.

From the centered position shown in FIG. 8 to the position shown in FIG. 9, the joystick would be moved rightwardly, causing ccw rotation of the gantry. Electronically, a "Joyccw" signal would be received at connector P9, that tells the microprocessor that the joystick has been moved rightwardly. The microprocessor, in turn, sends appropriate enabling and directional signals to PX2, instructing ccw rotation of the rotational motor. These signals in turn cause the daughter board for the rotational motor to rotate the motor in a ccw direction for as long as the joystick is moved rightwardly, or until such time as the gantry contacts the limit sensor, at which time rotation would hit a "hard stop".

Similarly, to move from the centered position shown in FIG. 8 to the position shown in FIG. 10, a "Joycw" signal would be received at connector P9, that tells the microprocessor that the joystick has been moved leftwardly. The microprocessor, in turn, sends appropriate enabling and directional signals to PX2, instructing CW rotation of the rotational motor. These signals, in turn, cause the daughter board for the rotational motor to rotate the motor in a cw direction for as long as the joystick is moved leftwardly, or until such time as the gantry contacts the limit sensor, at which time rotation would hit a "hard stop".

Similarly, to move from the centered position shown in FIG. 8 to the position shown in FIG. 11, a "Joyr+"signal would be received at connector P9, that tells the microprocessor that the joystick has been moved in the r− direction. The microprocessor, in turn, sends appropriate enabling and directional signals to PX3, instructing the front/back motor (via its daughter board) to cause translational movement of the crane in the r+ direction. This movement continues for as long as the joystick is positioned in an r+ direction, or until such time as the gantry contacts the limit sensor, at which time translation would hit a "hard stop".

Similarly, to move from the centered position shown in FIG. 8 to the position shown in FIG. 12, a "Joyr−" signal would be received at connector P9, that tells the microprocessor that the joystick has been moved in the r− direction. The microprocessor, in turn, sends appropriate enabling and directional signals to PX3, instructing the front/back motor (via its daughter board) to cause translational movement of the crane in the r− direction. This movement continues for as long as the joystick is positioned in an r− direction, or until such time as the gantry contacts the limit sensor, at which time translation would hit a "hard stop".

Once the player has positioned the claw above a desired prize, she then presses pushbutton 121 on the joystick which, in turn, sends a signal JoyBtn to front door connector P9. This signal is processed by the microprocessor, which, in turn, sends appropriate enabling and directional signals to connector PX1, instructing the up/down motor (via its daughter board) to cause translational movement of the claw in the Z− direction, and shown in FIG. 13. As the claw proceeds downwardly in the Z− direction, the claw is in an open position. This downward movement of the claw continues, in a preferred embodiment, until the claw contacts a desired prize, or any obstacle (e.g., floor), at which point a sensor, operatively arranged to sense slack (or tautness) in the power cable for the claw. The sensor sends a ClawDn signal to carriage/gantry connector P1, which signal passes through its filter network and through RN15/43 to become filtered signal CD. This signal is sent to pin 78 of U2. U2 then deasserts signal Z− to stop the claw from moving down. Immediately after stopping the claw downward movement, the claw closes as shown in FIG. 26A. To close the claw, a signal CLAWC is sent from pin 34 of U2 to U3, which, in turns provides the necessary 36V signal to pin 14 (CLAW) of connector P1, closing the circuit to energize the coil in the claw, thereby closing the coil.

After a preprogrammed time (of approximately ½ second), the claw is programmed to travel in the upward Z+ direction. This is accomplished by the processor asserting the Z+ signal at pin 115, which transfers the appropriate signal to PX1, which transfers the appropriate signal to the up/down motor control daughter board to move the claw upwardly (via appropriate signals at connector P1 for MotUp). The claw continues in an upward direction until signal ClawUp is asserted at pin 4 of P1, which is interpreted via the CU signal of the filter network by the microprocessor (pin 79), and then processed by the microprocessor to de-assert the Z+ movement.

At this point, depending on the position at the time of grabbing the prize, the microprocessor sends appropriate signals and output commands to position the crane and claw directly over the prize ejection chute (at its home position). The microprocessor "knows" the crane is in its home position when a signal is asserted at the HomeL/R pin of connector P1, which means it is rotationally home, and when a signal is asserted at the HomeF/B pin of connector P1, which means it is translationally home. At this point, the CLAWC signal is de-asserted (after about a one second wait), removing power from the claw, causing the claw to open due to the spring and weight, thereby releasing any prize held in the claw into the prize chute. The machine then waits about two seconds. If no prize signal is detected (shown as Prize in upper right of FIG. 28), the game will play a game loss sound. If a prize signal is detected, the game will play a game win sound.

Figure 31:
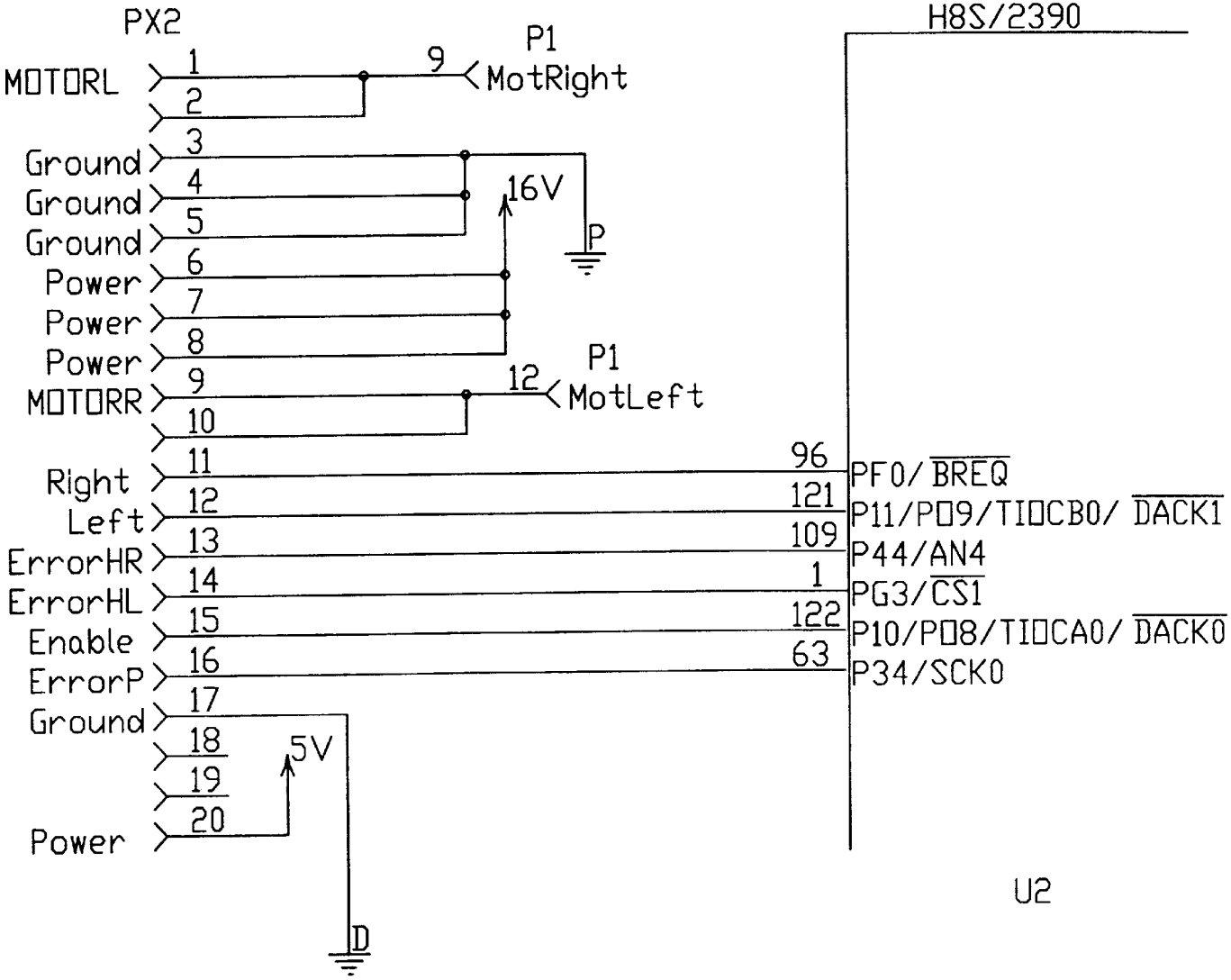
Figure 32:
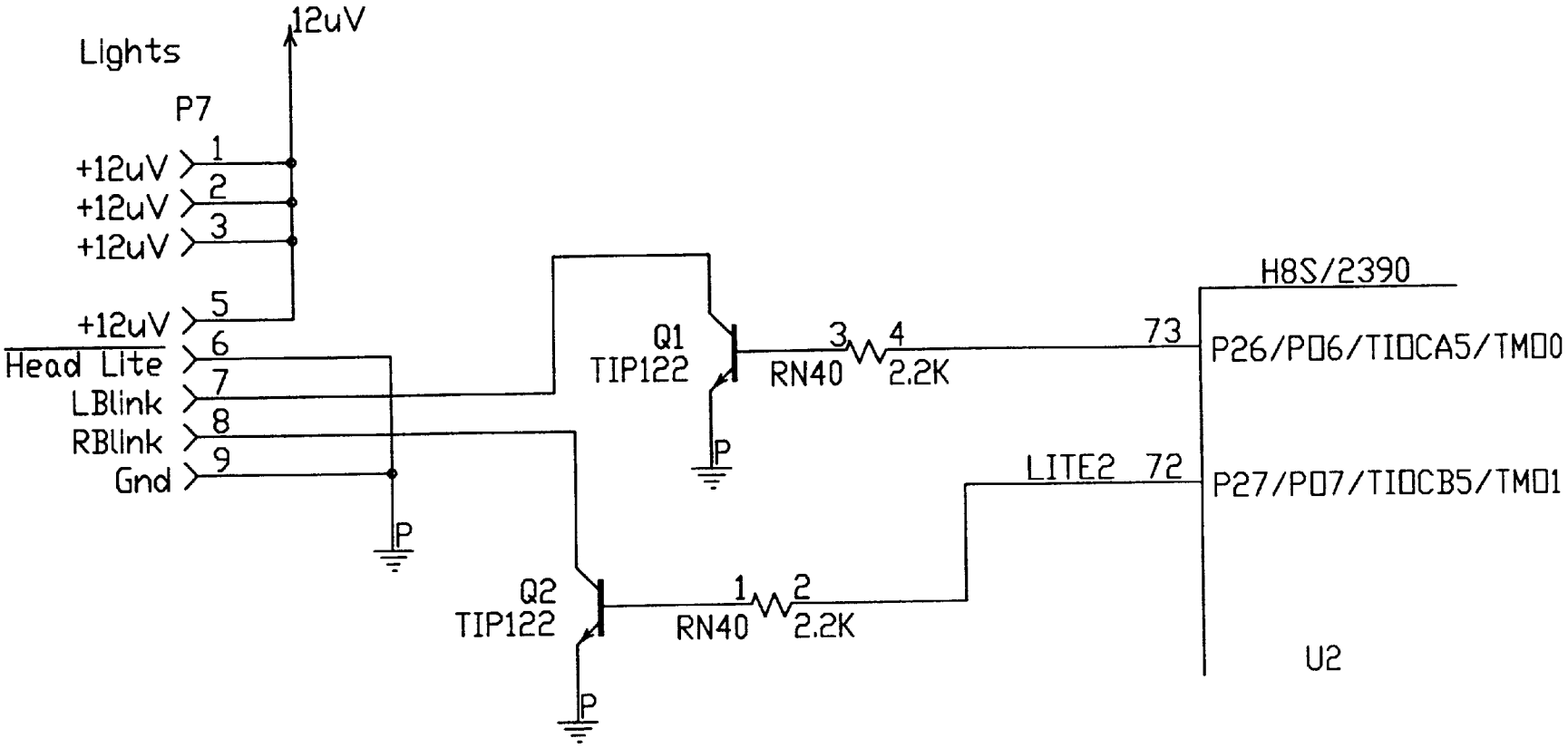
Figure 33:
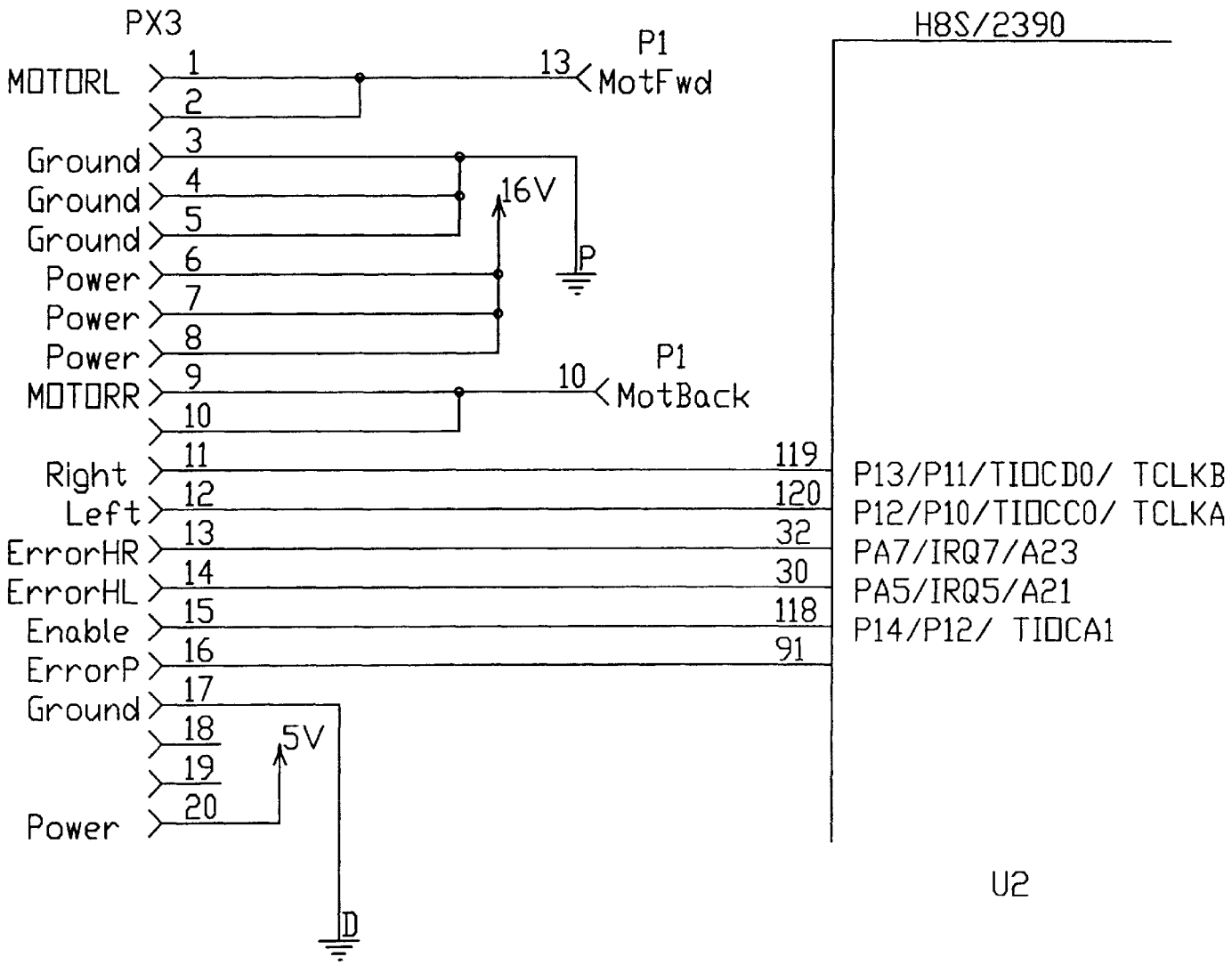
Figure 34:
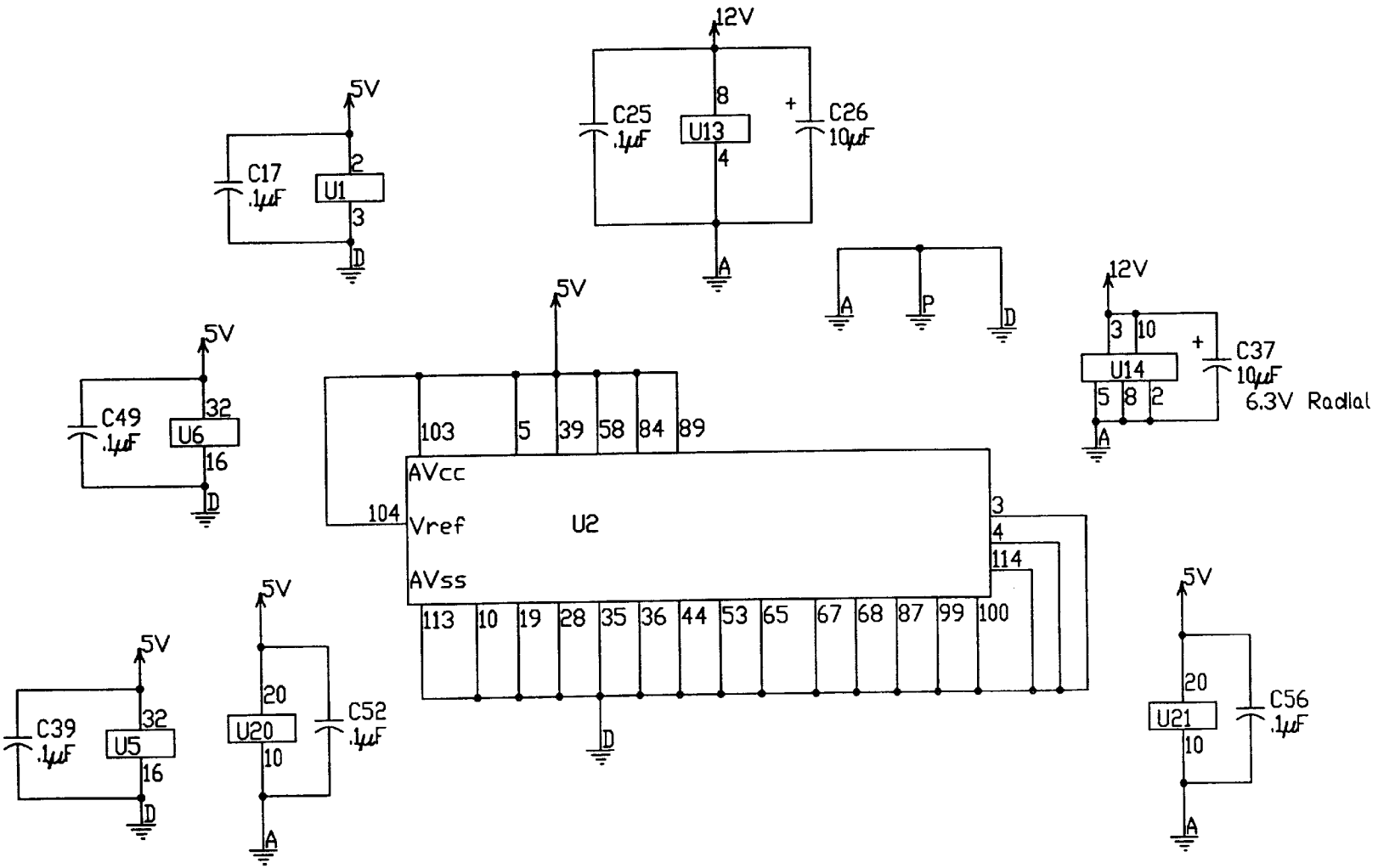

In a preferred embodiment, the game includes two displays, both dual LED displays. One display is used to display credits, and the other is used to display time remaining in the game. In a preferred embodiment, the game is preprogrammed for a game time of 20 seconds, but this is of course programmable. The LED display drive circuits are shown in FIG. 31. Operation of the drive circuit is well known in the art.

Figure 30:
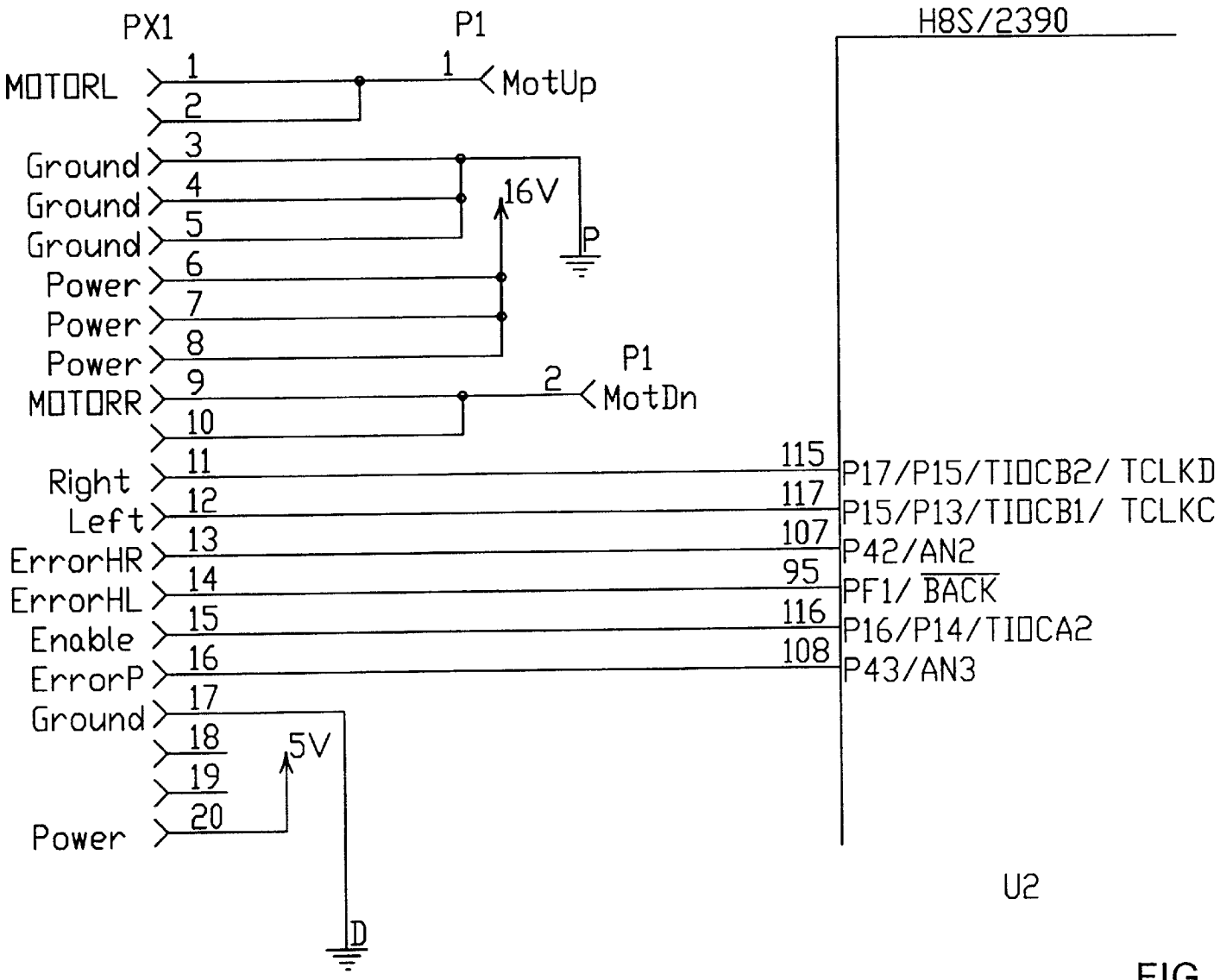

The game also includes a prize detection apparatus and circuit. The prize detector generally comprises four LED light sources shown in FIG. 30. The LEDs are arranged in the prize chute and the light is arranged to traverse the chute and reflect off a mirror on the opposite side of the chute. The light is "seen" by phototransistors Q1–Q4, respectively, which light turns the transistors on. When one of the transistors stops seeing light, due to a prize breaking the light beam, one of the comparators, U2 (connected in a common collector manner) goes low to indicate the existence of a prize. The microprocessor then sends appropriate signals to play a prize sound.

Figure 29:
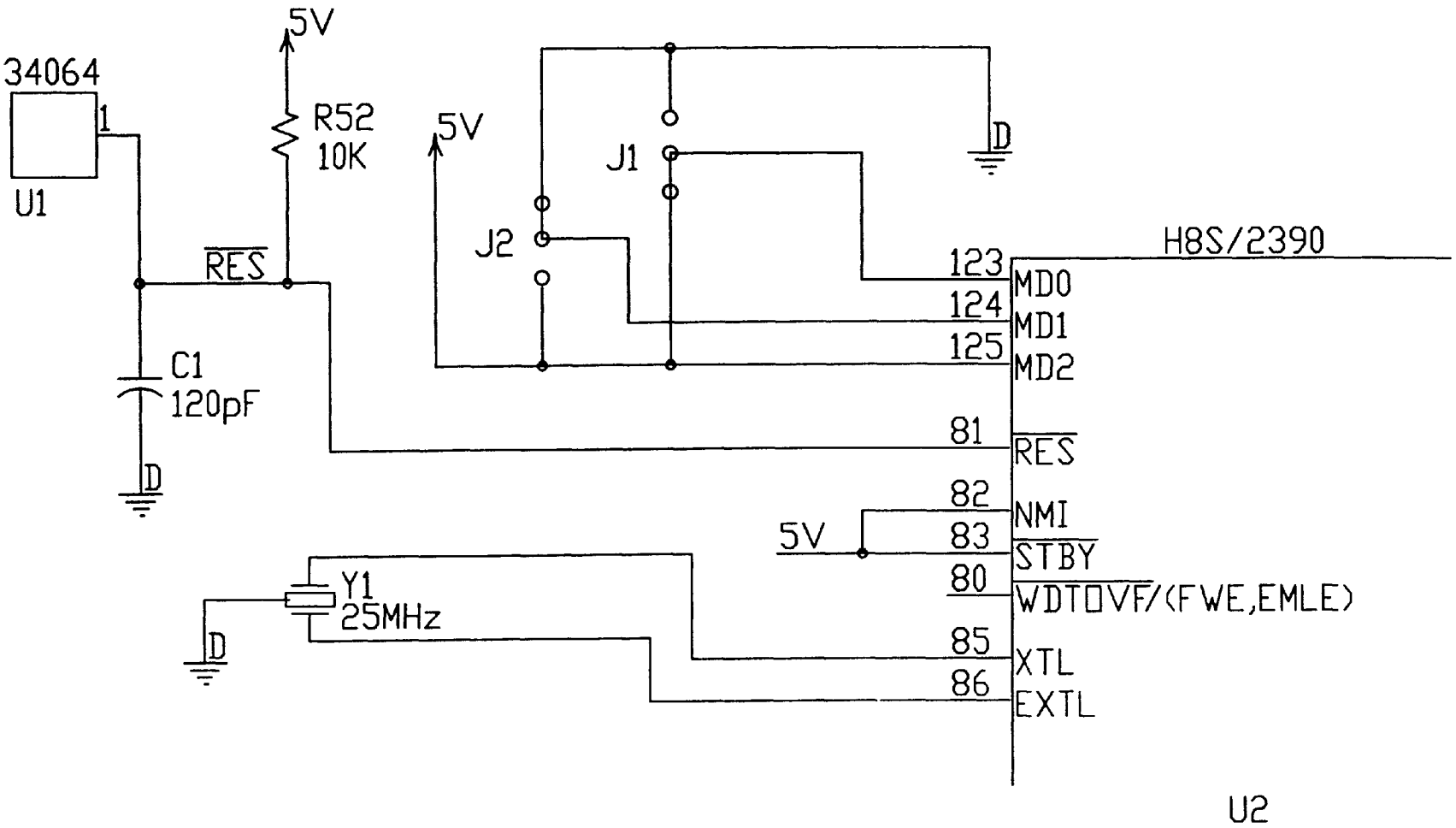

As described previously, the game includes three motors: a front/back motor, an up/down motor for the claw, and a rotational motor. There are therefore three controller daughter boards to control the three motors. The controller circuits for the two translational (front/back and up/down) motors are identical, and shown in FIG. 29. The circuit includes three inputs MB1L, MB1R and MB1P. MB1P is the enable line, and the remaining two inputs are used to signal movement in a first (up or forward) or second (down or back) direction. The drive circuit is a standard H bridge configuration. When the enable signal is low, transistors Q1 and Q2 are turned off, so the motor can't be energized. When the enable signal is high, transistors Q1 and Q2 are enabled, so the motor can be energized. The polarity and direction of rotation of the motor is, of course, determined by the control signals MB1L and MB1R. With the enable signal high, a high signal at MB11 results in a high output signal from pin 11 of AND gate U4, thereby turning on Q1 to provide power to the motor at MB11. With the enable signal high, a high signal at MB1R results in a high output signal from pin 8 of AND gate U4, thereby turning on Q2 to provide power to the motor at MB102. The H bridge thus functions to provide power to, and, depending on the received input signals, change the polarity of the applied voltage to the motor, to change the direction of rotation.

As described previously, the controller board for the brushless DC rotational motor may be purchased directly from Oriental Motor U.S.A. Corp. In a preferred embodiment, a driver model AXHD50K from Oriental drives the rotational motor.

Thus, it is seen that the objects of the present invention are efficiently obtained, although it should be readily apparent to those having ordinary skill in the art that changes and modifications can be made to the invention without departing from the spirit and scope of the invention as claimed. It should especially be appreciated that the subject game is programmable, both by the manufacturer and by the user. Hence, it should be appreciated that variations of the game may be made, used and sold, and yet be within the spirit and scope of the claims, since the programmability of the game inherently invites such variations.

What is claimed is:

1. A cylindrically shaped crane amusement game, comprising:

cylindrically shaped cabinet enclosing a game prize platform; and, a gantry including means for grabbing a prize arranged on said platform, wherein said gantry is operatively arranged for rotational movement.

2. The cylindrically shaped crane amusement game recited in claim 1 wherein said means for grabbing a prize comprises a claw.

3. The cylindrically shaped crane amusement game recited in claim 2 further comprising means for effecting translational movement of said claw.

4. The cylindrically shaped crane amusement game as recited in claim 2 wherein said claw is operatively arranged for rectilinear (x-y-z) movement.

5. The cylindrically shaped crane amusement game as recited in claim 2 wherein position of said gantry and claw are controllable by a player via control means.

6. The cylindrically shaped crane amusement game as recited in claim 5 wherein said control means comprises a joystick.

7. The cylindrically shaped crane amusement game as recited in claim 5 wherein said control means comprises a pushbutton.

8. The cylindrically shaped crane amusement game as recited in claim 5 wherein said player control means comprises a wheel.

9. The cylindrically shaped crane amusement game recited in claim 1 wherein said means for grabbing a prize comprises a magnet.

10. The cylindrically shaped crane amusement game recited in claim 1 wherein said platform is stationary.

11. The cylindrically shaped crane amusement game recited in claim 1 wherein said platform is operatively arranged for movement.

12. The cylindrically shaped crane amusement game recited in claim wherein said platform is operatively arranged for rotation.

13. The cylindrically shaped crane amusement game recited in claim 1 wherein said platform is arcuately shaped.

14. The cylindrically shaped amusement game recited in claim 1 wherein said platform is in the shape of a polygon.

15. The cylindrically shaped crane amusement game recited in claim 1 wherein said gantry comprises a crane, said crane operatively arranged for translational movement along said gantry.

16. A cylindrically shaped crane amusement game comprising:

a cylindrically shaped cabinet enclosing a game prize platform;

a gantry including means for grabbing a prize arranged on said platform, wherein said means is a claw; and, means for effecting translational movement of said claw, wherein said means for effecting translational movement of said claw comprises a motor-driven crane arranged for movement along a pair of parallel disposed rails.

17. A cylindrically shaped crane amusement game comprising:

a cylindrically shaped cabinet enclosing a game prize platform;

a gantry including means for grabbing a prize arranged on said platform; and, means for rotating said gantry.

18. A crane amusement game, comprising:

a cabinet enclosing a game prize platform;

a gantry operatively arranged for rotational movement, and, a claw operatively arranged for translational movement, said claw operatively arranged to grab a prize arranged on said platform.

19. The crane amusement game as recited in claim 18 wherein said cabinet is cylindrically shaped.

20. The crane amusement game as recited in claim 18 wherein said cabinet is polygonal.

21. The crane amusement game as recited in claim 18 wherein said prize platform is actuate.

22. The crane amusement game as recited in claim 18 wherein said prize platform is polygonal.

23. The crane amusement game as recited in claim 18 wherein said prize platform is stationary.

24. The crane amusement game as recited in claim 18 wherein said prize platform is operatively arranged for movement.

25. The crane amusement game as recited in claim 18 wherein said gantry comprises a crane, said crane operatively arranged for translational movement along said gantry.

26. The crane amusement game as recited in claim 18 wherein said gantry comprises a crane and a pair of parallel disposed rails, said crane operatively arranged for translational movement along said rails.

27. The crane amusement game as recited in claim 18 wherein position of said gantry and claw are controllable by a player via control means.

28. The crane amusement game as recited in claim 27 wherein said control means comprises a joystick.

29. The crane amusement game as recited in claim 27 wherein said control means comprises a pushbutton.

30. The crane amusement game as recited in claim 27 wherein said control means comprises a wheel.

31. The crane amusement game is recited in claim 27 wherein said control means comprises a trackball.

32. A method of electronically controlling a means for grabbing a prize in an amusement game, comprising the steps of:

moving said means in a rotational direction;

moving said means in a first translational direction; and, moving said means in a second translational direction, where said first and second translational directions are generally perpendicular to one another.

* * * * *

UNITED STATES PATENT AND TRADEMARK OFFICE

CERTIFICATE OF CORRECTION

PATENT NO. : 6,588,760 B2 
DATED : July 8, 2003
INVENTOR(S) : Shane P. Carter, Jr., Edward Dluzen and Michael Andrews It is certified that error appears in the above-identified patent and that said Letters Patent is hereby corrected as shown below:

Column 18,
Line 39, after "claim" and before "wherein" insert -- 11 --.

Signed and Sealed this

Seventh Day of October, 2003

JAMES E. ROGAN
*Director of the United States Patent and Trademark Office*